US008750771B2

(12) United States Patent
Ito et al.

(10) Patent No.: US 8,750,771 B2
(45) Date of Patent: Jun. 10, 2014

(54) IMAGE FORMING APPARATUS HAVING A PLURALITY OF LATENT IMAGE INDEXES

(75) Inventors: Yoshikuni Ito, Tokyo (JP); Yoshihiro Shigemura, Yokohama (JP); Ichiro Okumura, Abiko (JP); Seiji Hara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 13/428,096

(22) Filed: Mar. 23, 2012

(65) Prior Publication Data

US 2012/0269528 A1 Oct. 25, 2012

(30) Foreign Application Priority Data

Apr. 19, 2011 (JP) ..... 2011-093218
Apr. 19, 2011 (JP) ..... 2011-093219

(51) Int. Cl.
*G03G 15/01* (2006.01)
*G03G 15/18* (2006.01)

(52) U.S. Cl.
USPC ..... 399/301; 347/116; 399/49; 399/302

(58) Field of Classification Search
USPC ..... 399/301, 49, 72, 302, 394, 396; 347/116
See application file for complete search history.

(56) References Cited

U.S. PATENT DOCUMENTS

| | | | | |
|---|---|---|---|---|
| 8,064,810 | B2 | 11/2011 | Okumura et al. | |
| 8,175,478 | B2 | 5/2012 | Okumura et al. | |
| 2010/0209124 | A1* | 8/2010 | Mizutani et al. | 399/16 |
| 2012/0008995 | A1 | 1/2012 | Shigemura et al. | |
| 2012/0121283 | A1* | 5/2012 | Mori et al. | 399/301 X |

FOREIGN PATENT DOCUMENTS

| | | | |
|---|---|---|---|
| JP | 11-183542 | A | 7/1999 |
| JP | 2003-161645 | A | 6/2003 |
| JP | 2004-145077 | A | 5/2004 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a first index forming unit that forms a plurality of first electrostatic latent image indexes at positions adjacent to a toner image to be formed on a recording material in a width direction of a first image bearing member and a second index forming unit forms a plurality of second electrostatic latent image indexes at positions adjacent to a toner image to be formed on the recording material in a width direction of a second image bearing member. A control unit controls operation of at least a second image forming unit so as to maintain a set positional relationship between the first electrostatic latent image indexes transferred to an intermediate transfer member and the second electrostatic latent image indexes based on detection results by first and second detection units.

6 Claims, 23 Drawing Sheets

FIG. 9A
FIG. 9B
FIG. 9C
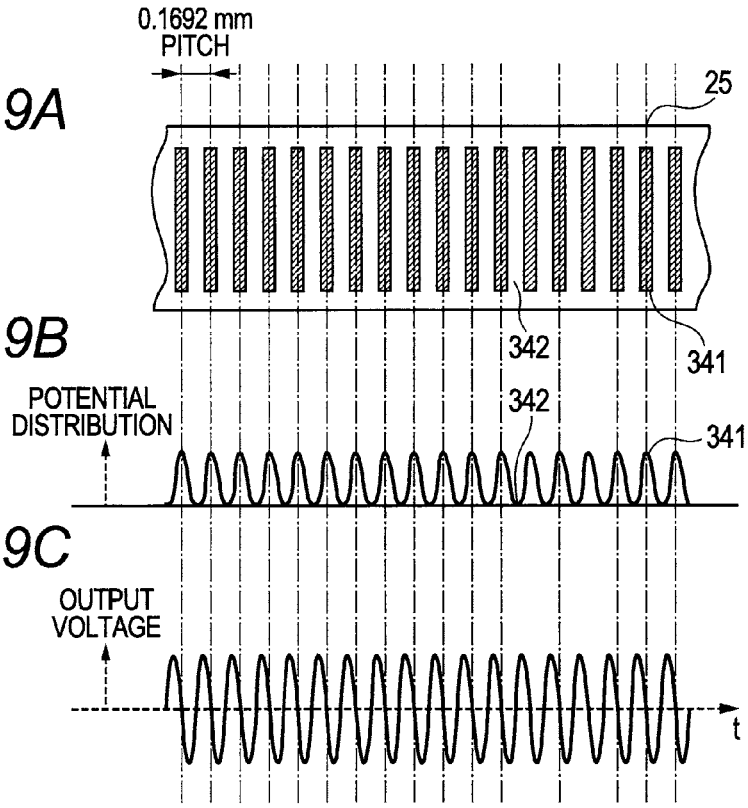
FIG. 10
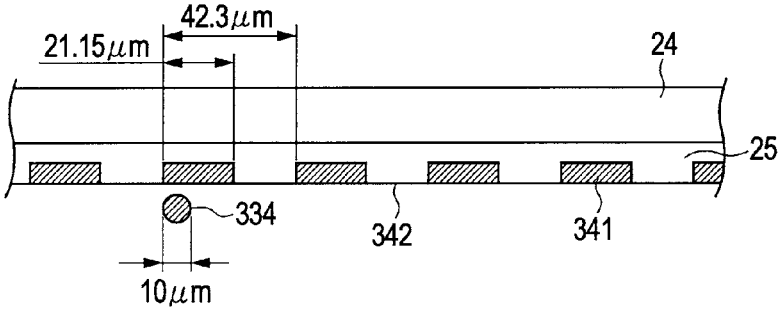

IMAGE FORMING APPARATUS HAVING A PLURALITY OF LATENT IMAGE INDEXES

BACKGROUND OF THE INVENTION

1. Field of the Invention

The present invention relates to an image forming apparatus, such as a color printer and a color copier using an electrophotographic recording system, that particularly includes a plurality of image forming units and that can form a color image.

2. Description of the Related Art

In a color image forming apparatus using an electrophotographic system, various color image forming apparatuses using a so-called tandem system are proposed. The color image forming apparatus using the tandem system includes a plurality of image forming units for faster speed and sequentially transfers images of different colors, yellow Y, magenta M, cyan C, and black Bk, to a recording material held on an intermediate transfer belt or on a transport belt. As problems of the color image forming apparatus using the tandem system which includes a plurality of image forming units for faster speed, there are speed fluctuations of a plurality of photosensitive drums or an intermediate transfer belt and meandering of the intermediate transfer belt caused by machine accuracy and other factors.

Therefore, at the transfer position of each image forming unit, an amount of movement of the outer surface of the photosensitive drum and an amount of movement of the intermediate transfer belt vary in each color, and it is difficult to perfectly superimpose the images of each color.

Japanese Patent Application Laid-Open No. 2004-145077 proposes a method of correcting the deviation of the images during image formation, and FIGS. 29A and 29B show the configuration. In FIGS. 29A and 29B, photosensitive members 1M, 1Y, 1C and 1K and an intermediate transfer member 51 include information writing areas that can be rewritten in the sub scanning direction of each surface. The photosensitive members 1M, 1Y, 1C and 1K and the intermediate transfer member 51 include writing units 112M, 112Y, 112C and 112K and 512K that write information in the information writing areas, detection units 113M, 113Y, 113C and 113K and 513M, 513Y and 513C that detect information, and deletion units 111M, 111Y, 111C and 111K and 511 that delete information.

At a transfer section of a photosensitive member 1C, a detection signal of a pattern detected by a detection head 113C and written by a writing head 112C of the photosensitive member 1C and a detection signal of a pattern detected by a detection head 513C and written by a writing head 512K on the intermediate transfer member 51 are compared. As a result, an amount of color deviation based on black can be detected, and the rotational speed of the photosensitive member 1C can be controlled to match the position of the color based on black. The same applies to yellow and magenta.

However, the detection units 113M, 113Y, 113C and 113K and 513M, 513Y and 513C that respectively detect information of the photosensitive drum and the intermediate transfer belt are separately arranged on the front surface and the back surface of the intermediate transfer belt 51 in Japanese Patent Application Laid-Open No. 2004-145077, and the following problem occurs.

A detection unit that detects information written on the photosensitive drum and a writing unit that writes information on the intermediate transfer belt are arranged on the same main scanning line at the image transfer position of the photosensitive drum and the intermediate transfer belt. In this case, a relative positioning error occurs, and a read error and a write error occur when the information on the photosensitive drum is read and written on the intermediate transfer belt.

The positioning error is generally several μm to several dozen μm. Depending on the system, the read error and the write error are generally about several μm due to fluctuations in the tilts of the detection unit and the writing unit or the tilt of the intermediate transfer belt. A relative positional deviation of the detection unit and the writing unit of about several μm may occur due to influence of the temperature.

SUMMARY OF THE INVENTION

The present invention provides an image forming apparatus that can reduce a color deviation in a recording medium transport direction.

The present invention provides an image forming apparatus including a movable intermediate transfer member; a first image forming unit that includes a rotatable first image bearing member, and that forms a toner image to be transferred to the intermediate transfer member on the first image bearing member; a second image forming unit that is arranged on a downstream side of the first image forming unit in a moving direction of the intermediate transfer member, that includes a rotatable second image bearing member, and that forms a toner image to be transferred to the intermediate transfer member on the second image bearing member; a first index forming means that forms a plurality of first electrostatic latent image indexes at positions adjacent to a toner image to be formed on a recording material in a width direction of the first image bearing member, the first electrostatic latent image indexes formed along the toner image to be formed on the recording material from a position on an upstream side of a leading end of the toner image to be formed on the recording material in a rotation direction of the first image bearing member, and a section of the first electrostatic latent image indexes which is formed on the upstream side of the leading end of the toner image, and which is formed so as to have larger index intervals than a section adjacent to the toner image; a transfer unit that transfers the first electrostatic latent image indexes formed on the first image bearing member to the intermediate transfer member; a second index forming means that forms a plurality of second electrostatic latent image indexes at positions adjacent to a toner image to be formed on the recording material in a width direction of the second image bearing member, the second electrostatic latent image indexes formed along the toner image to be formed on the recording material from a position on an upstream side of a leading end of the toner image to be formed on the recording material in a rotation direction of the second image bearing member, and a section of the second electrostatic latent image indexes which is formed on the upstream side of the leading end of the toner image, and which is formed so as to have larger index intervals than a section adjacent to the toner image; a control unit that controls an operation of at least the second image forming unit so as to maintain a set positional relationship between the first electrostatic latent image indexes and the second electrostatic latent image indexes transferred to the intermediate transfer member; and an operation start control unit that starts controlling the operation of at least the second image forming unit so as to maintain the set positional relationship between the sections of the first and second electrostatic latent image indexes with the larger index intervals.

The present invention also provides an image forming apparatus including: a movable intermediate transfer member; a first image forming unit that includes a rotatable first image bearing member, and that forms a toner image to be transferred to the intermediate transfer member on the first image bearing member; a second image forming unit that is arranged on a downstream side of the first image forming unit in a moving direction of the intermediate transfer member, that includes a rotatable second image bearing member, and that forms a toner image to be transferred to the intermediate transfer member on the second image bearing member; a first index forming means that forms a plurality of first electrostatic latent image indexes at positions adjacent to a toner image to be formed on a recording material in a width direction of the first image bearing member, the first electrostatic latent image indexes formed along the toner image to be formed on the recording material from a position on an upstream side of a leading end of the toner image to be formed on the recording material in a rotation direction of the first image bearing member, and a section of the first electrostatic latent image indexes which is formed on the upstream side of the leading end of the toner image, and which is formed so as to have larger index intervals than a section adjacent to the toner image; a transfer unit that transfers the first electrostatic latent image indexes formed on the first image bearing member to the intermediate transfer member; a second index forming means that forms a plurality of second electrostatic latent image indexes at positions adjacent to a toner image to be formed on the recording material in a width direction of the second image bearing member, the second electrostatic latent image indexes formed along the toner image to be formed on the recording material from a position on an upstream side of a leading end of the toner image to be formed on the recording material in a rotation direction of the second image bearing member, and a section of the second electrostatic latent image indexes which is formed on the upstream side of the leading end of the toner image, and which is formed so as to have larger index intervals than a section adjacent to the toner image; a first detection unit that comes in contact with a surface of the intermediate transfer member opposite a surface of the intermediate transfer member facing the second image bearing member, and that detects the second electrostatic latent image indexes; a second detection unit that comes in contact with the surface of the intermediate transfer member opposite the surface of the intermediate transfer member facing the second image bearing member, and that detects the first electrostatic latent image indexes transferred to the intermediate transfer member; and a control unit that controls an operation of at least the second image forming unit so as to maintain a set positional relationship between the first electrostatic latent image indexes transferred to the intermediate transfer member and the second electrostatic latent image indexes based on detection results by the first detection unit and the second detection unit.

Further objects of the present invention will become apparent from the following description.

Further features of the present invention will become apparent from the following description of exemplary embodiments with reference to the attached drawings.

BRIEF DESCRIPTION OF THE DRAWINGS

FIG. 9A illustrates indexes with a pitch of 0.1692 mm formed by the charge at a transferred section.

FIG. 9B illustrates a potential distribution of the transferred section.

FIG. 9C illustrates output voltages when the indexes are detected.

FIG. 10 illustrates a size when the potential sensor detects indexes with a pitch of 0.0423 mm by the charge.

DESCRIPTION OF THE EMBODIMENTS

Embodiments of the present invention will now be described in detail in accordance with the accompanying drawings.

Hereinafter, a color image forming apparatus as an embodiment of the present invention will be described with reference to the drawings. The color may be full-color or may be one-color (for example, only red in addition to black).

First Embodiment

FIGS. 1 to 5B illustrate a configuration of the present embodiment. First to fourth image forming units 43*a*, 43*b*, 43*c*, and 43*d* in FIG. 2 form toner images of yellow, magenta, cyan, and black colors in this order. Photosensitive drums 12*a* to 12*d* are rotatable and form images corresponding to the colors in respective effective image areas. The photosensitive drums 12*a* to 12*d* form first electrostatic latent image indexes 31*a* to 31*d* (FIG. 1) in index drawing areas starting from a leading end margin that is a side end in a direction intersecting a movement direction and that precedes the effective image areas in the movement direction. In the present embodiment, the leading end margin preceding the effective image areas includes an inter-paper section.

Drum drive motors 6*a* to 6*d* are rotated based on output signals from drum encoders 8*a* to 8*d*, and the photosensitive drums 12*a* to 12*d* are controlled to rotate at a constant angular velocity in an arrow direction (counterclockwise direction).

Figure 2:
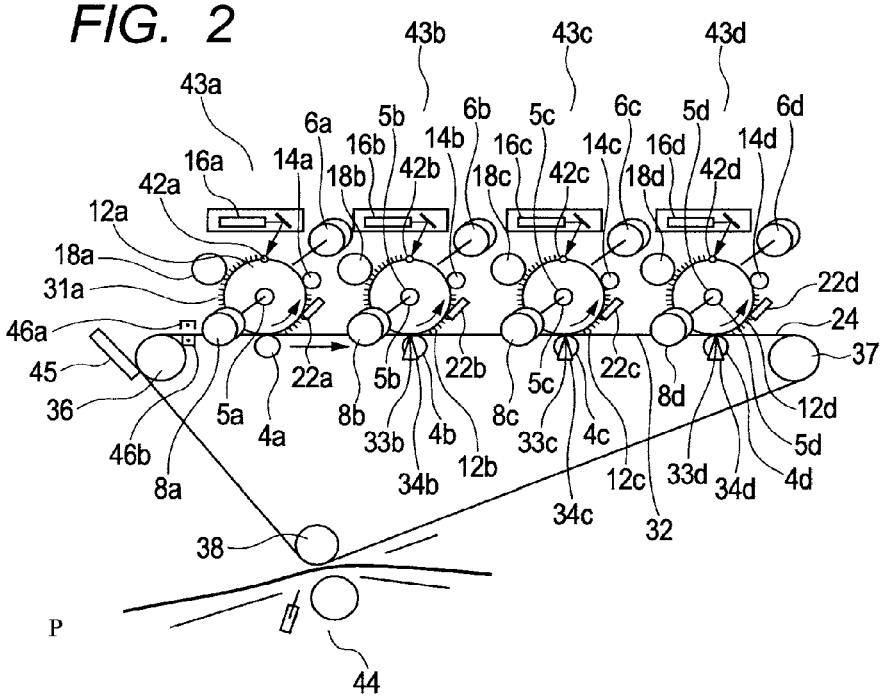
FIG. 2 is a front view illustrating the first embodiment of the present invention.

In FIG. 2, charge units 14*a* to 14*d*, exposure units 16*a* to 16*d*, development units 18*a* to 18*d*, primary transfer rollers 4*a* to 4*d*, and drum cleaning units 22*a* to 22*d* are arranged around the photosensitive drums 12*a* to 12*d* in the direction of rotation, substantially in this order. The drum drive motors 6*a* to 6*d* rotate and drive the photosensitive drums 12*a* to 12*d* around drum rotation axes 5*a* to 5*d* in the arrow directions, and the charge units 14*a* to 14*d* uniformly charge the photosensitive drums 12*a* to 12*d*. The exposure units 16*a* to 16*d* expose exposure positions 42*a* to 42*d* of the charged photosensitive drums 12*a* to 12*d* based on an image signal, and electrostatic latent images of the colors are formed.

The development units 18 develop the electrostatic latent images on the photosensitive drums 12*a* to 12*d* as toner images of the colors. The primary transfer rollers 4*a* to 4*d* sequentially and primarily transfer the toner images of four colors on an intermediate transfer belt 24 as an intermediate transfer member. The toner images of four colors are superimposed on the intermediate transfer belt 24. The movable intermediate transfer belt 24 is wound around at least three rollers: a belt drive roller 36 that provides rotational driving force; a belt driven roller 37; and a secondary transfer roller 38. The belt driven roller 37 or the secondary transfer roller 38 provides a constant tension to the intermediate transfer belt 24.

A secondary transfer roller 38 secondarily transfers, to a recording material (paper), the toner images of four colors superimposed on the intermediate transfer belt 24. A belt cleaning unit 45 removes toner (secondary transfer residual toner) remaining on the intermediate transfer belt 24 without being transferred to the recording material P in the secondary transfer. Drum cleaning units 22*a* to 22*d* removes toner (primary transfer residual toner) remaining on the photosensitive drums 12*a* to 12*d* without being transferred to the intermediate transfer belt 24 in the primary transfer.

Hereinafter, a configuration of the image forming unit 43*a* as a first image forming unit will be illustrated, and a configuration of the second and subsequent image forming unit 43*b* will be illustrated, the image forming unit 43*b* representing the second and subsequent image forming units 43*b*, 43*c*, and 43*d*.

(First Image Forming Unit)

Figure 1:
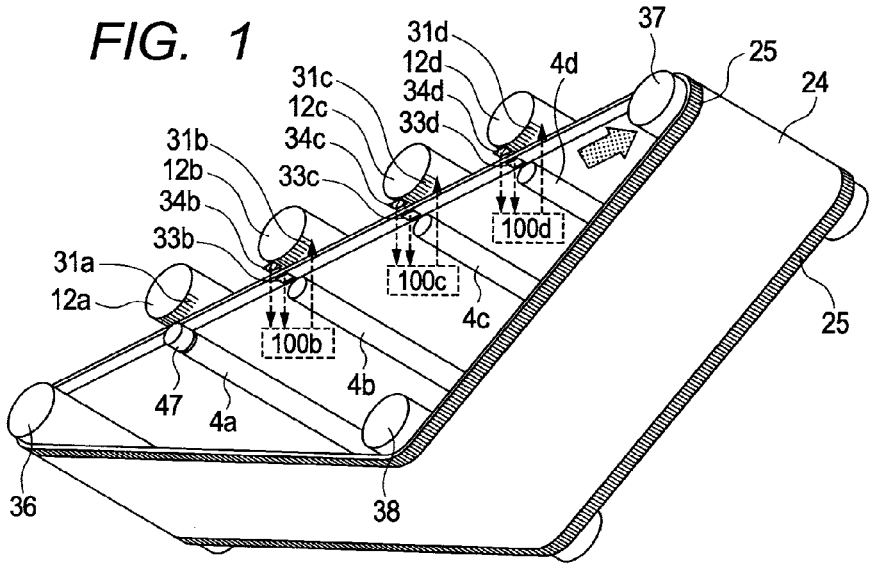
FIG. 1 is a perspective view illustrating a first embodiment of the present invention.

Driving force is transmitted to the first photosensitive drum 12*a* in the first image forming unit 43*a* at the uppermost stream, through a driving system that transmits the driving force from a drum drive motor 6*a* on the far side of FIG. 1 to a drum rotation axis 5*a*. A drum encoder 8*a* made of a rotary encoder is connected to the drum rotation axis 5*a* on the near side of FIG. 2 through a coupling (not illustrated). The first image forming unit 43*a* always rotates the drum drive motor 6*a* based on an output signal from the drum encoder 8*a*. In this way, the photosensitive drum 12*a* is controlled to rotate at a constant angular velocity counterclockwise in the arrow direction.

(Formation of Electrostatic Latent Image Indexes Preceding Latent Images)

In the present embodiment, photosensitive drums made of OPC photosensitive members are used in which the film thickness of the photosensitive layer is 30 μm. To form a toner image on the surface of the photosensitive drums 12*a*, the charge unit 14*a* uniformly applies a negative charge of about −600 V to the photosensitive member on the photosensitive drum surface. The first exposure unit 16*a* scans with the laser light in accordance with an image signal and changes the surface potential of the laser light irradiation section on the surface of the first photosensitive drum 12*a* to about −100 V to form a latent image. In this case, as illustrated in FIG. 1, the electrostatic latent image index lines 31*a* as first electrostatic latent image indexes are written at the side end in the direction intersecting the movement direction.

More specifically, at a position extending an exposure position 42*a* of the first photosensitive drum 12*a*, the electrostatic latent image index lines 31*a* are written by irradiation of laser light before and during writing of an image at both side ends outside the effective image area. The electrostatic latent image index lines 31*a* are formed just after the start of the rotation and drive of the photosensitive drum 12*a* before the image is written on the photosensitive drum 12*a*. Therefore, the writing is started from the leading end margin preceding the effective image area in the movement direction. The writing is continued until the image formation in the first photosensitive drum 12*a* is finished. The electrostatic latent image index lines 31*a* can be provided on one of the side ends, instead of both side ends.

Figure 3:
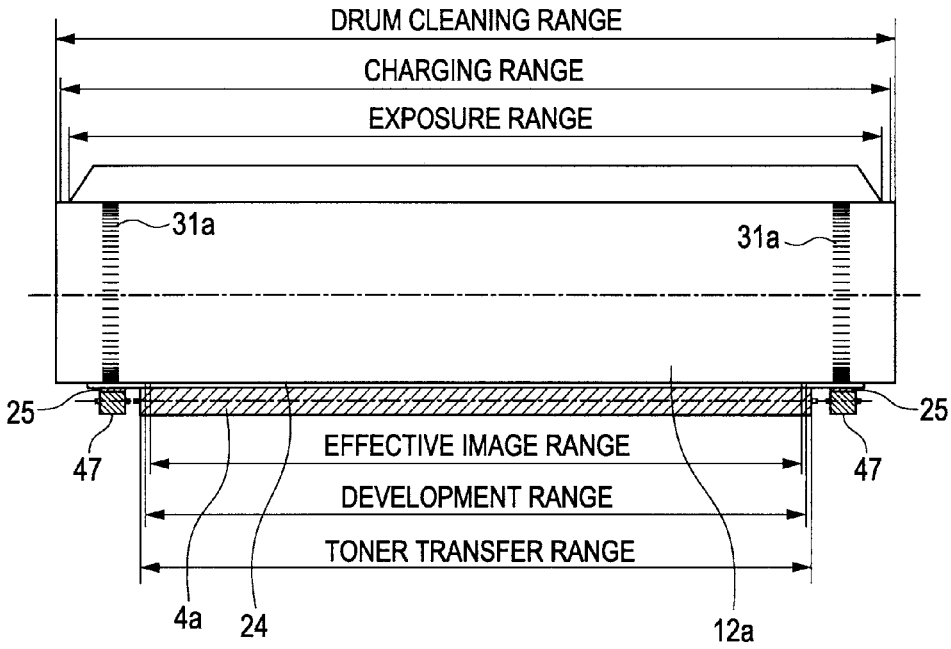
FIG. 3 is a side view illustrating a first image forming unit of the first embodiment of the present invention.

The size of the electrostatic latent image indexes 31*a* is about 5 mm in the axial direction of the photosensitive drum 12*a*, and when the resolution of the image in the sub scanning direction is 1200 dpi, the electrostatic latent image indexes 31*a* are formed at a 42.3 μm pitch based on 25.4/1200×2=0.0423333 . . . mm. A yellow Y toner negatively charged by the development unit 18*a* is adhered to the effective image area in which the surface potential is changed to about −100 V by the laser light irradiation, and a first image yellow Y is formed. In this case, as illustrated in FIG. 3, the development area, i.e. the effective image area, of the development unit 18*a* is determined so that the toner is not developed in the electrostatic latent image index lines 31*a* at both ends of the photosensitive drum 12*a*.

(Simultaneous Transfer of Latent Image and Electrostatic Latent Image Indexes 31*a* to Intermediate Transfer Belt)

The Y toner that forms the first image is transferred to the intermediate transfer belt 24 at a first transfer section where the first photosensitive drum 12*a* and the intermediate transfer belt 24 are in contact with each other. Specifically, the Y toner is transferred to the intermediate transfer belt 24 by positive electric field of about +1000 V applied by the primary transfer roller 4*a* that is formed by a sponge with about 16 mm diameter and with a conductive surface.

Figure 4:
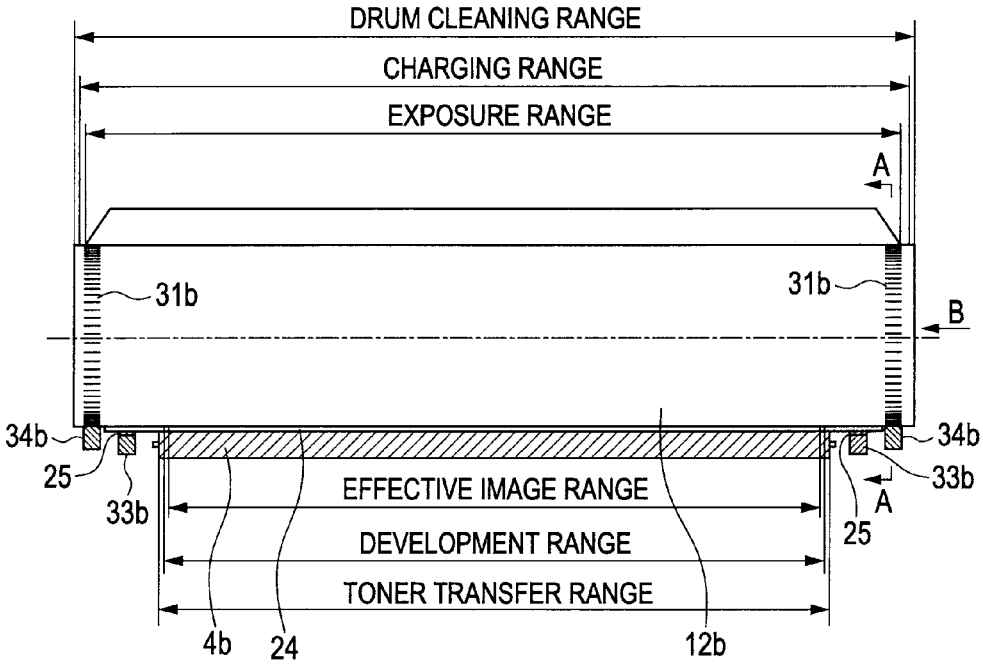
FIG. 4 is a side view illustrating a second image forming unit of the first embodiment of the present invention.

In this case, as illustrated in FIG. 4, the electrostatic latent image index lines 31*a* come in contact with transferred sections 25 provided at positions corresponding to the electrostatic latent image index lines 31*a* formed on the photosensitive drum 12*a* at both ends on the surface of the intermediate transfer belt 24. A high voltage of about +500 V is applied to electrostatic belt index transfer rollers 47 (second transfer rollers) arranged on both sides of the primary transfer roller 4*a*. As a result, part of the charge forming the electrostatic latent image indexes 31*a* is transferred to the transferred sections 25. In this way, electrostatic belt indexes 32 (second electrostatic latent image indexes) with the same pitch as the electrostatic latent image index lines are formed as illustrated in FIG. 2.

In this case, the potential difference between the exposed sections where the electrostatic latent image index lines 31*a* are formed and the electrostatic belt index transfer rollers 47 is about 600 V. Meanwhile, the potential difference between the exposed sections and the electrostatic belt index transfer rollers 47 at non-exposed sections of the parts between the electrostatic latent image index lines 31*a* is about 1100 V. Due to the difference between the two potential differences, the state of the discharge varies between the photosensitive drums 12*a* to 12*d* and the intermediate transfer belt 24 or between the intermediate transfer belt 24 and the primary transfer rollers 4*a* to 4*d*. In this way, the electrostatic latent image indexes are transferred to the intermediate transfer belt 24.

In the present embodiment, the intermediate transfer belt 24 is made of a material with volume resistivity of about $10^{10}$ Ω·cm, and the transferred sections 25 are made of a material with volume resistivity of $10^{14}$ Ω·cm or more. In this case, it is known from an experiment that the surface potential at the transferred section after the transfer is about +400 V at a latent image formation section irradiated with the laser light and is about +300 V at a section not irradiated with the laser light. More specifically, the indexes based on the difference between the surface potentials of −600 V and −100 V on the photosensitive drums are transferred as indexes based on the difference between the surface potentials of +400 and +300 V on the intermediate transfer belt.

As illustrated in FIG. 3, the transferred sections 25 are arranged on the surfaces at both side ends of the intermediate transfer belt 24 in the present embodiment, and the latent image belt index transfer rollers 47 are arranged at sections where the transferred sections 25 exist. The primary transfer roller 4*a* includes a conductive sponge roller and is connected to a high-voltage power supply (not illustrated). The primary transfer roller 4*a* sucks the toner on the photosensitive drum 12*a* and transfers the toner to the surface of the intermediate transfer belt by electrostatic force.

A high voltage different from that for the primary transfer roller 4*a* can be applied to the latent image belt index transfer rollers 47 made of conductive sponge rollers like the primary transfer roller 4*a*. The charge forming the electrostatic latent image indexes 31*a* can be transferred to the transferred sections 25 in an optimal transfer condition different from the transfer condition of the toner. The optimal transfer condition changes depending on the environmental fluctuations as in the case of the transfer of the toner.

As illustrated in FIG. 3, the sections of the intermediate transfer belt 24 where the transferred sections 25 are attached are thicker than the other sections. The latent image belt index transfer rollers 47, with a little different diameter than that of the primary transfer roller 4*a* made of the sponge roller, shrinks to absorb the thickness. Therefore, the thickness does not particularly affect the transport of the intermediate transfer belt. In the present embodiment, the transferred sections 25 are handled as part of the intermediate transfer belt 24.

The drum cleaning units 22*a* scrape off the toner that is not completely transferred to the intermediate transfer belt 24 and still attached to the surface of the photosensitive drum 12*a*, and the toner is collected in a waste toner box (not illustrated).

Although the latent image belt index transfer rollers 47 made of conductive sponge rollers are used in the present embodiment to transfer the latent image to the transferred sections 25, the arrangement is not limited to this. A corona charger using a wire, a charger using an electricity removal core used in an electricity removal device, or a blade charger may be used as a unit that provides the charge in the transfer of the latent image.

(Resistance at Transferred Sections of Intermediate Transfer Belt where Electrostatic Latent Image Indexes 31*a* are Transferred)

In the present embodiment, a PET film with a thickness of 0.05 mm that is made of a material with volume resistivity of $10^{14}$ Ω·cm or more and that is formed in a tape shape with a width of 5 mm is attached to both ends of the intermediate transfer belt 24 to form the transferred sections 25. Teflon (registered trademark) made of PTFE or a material made of polyimide may be coated to form the transferred sections 25. In the present embodiment, the transferred sections 25 are arranged on the back surface of the intermediate transfer belt 24.

The transferred sections 25 are made of a high-resistance material with volume resistivity of $10^{14}$ Ω·cm or more. Therefore, the charge once transferred is held without being moved, and the charge functions as the electrostatic belt indexes 32. Meanwhile, the intermediate transfer belt 24 is made of a medium-resistance material with volume resistivity of $10^{9}$ to $10^{10}$ Ω·cm to maintain the transfer performance. If the electrostatic latent image indexes 31*a* are caused to be in direct contact with the intermediate transfer belt 24, although the charge is once transferred, the charge is moved because the resistance value is low. The electrostatic belt indexes 32 cannot be formed in this state.

In the present embodiment, after a color image is formed on the intermediate transfer belt, the color image is secondarily transferred to a transferred medium such as recording paper. In this configuration, the transferred sections 25 made of a material with a volume resistance value different from that of the intermediate transfer belt 24 is attached. Alternatively, the transferred sections 25 are pained or coated by a spray to form areas with high volume resistivity. The material of the transferred sections 25 is not limited to PET, Teflon such as PTFE, and polyimide as long as the volume resistivity of the material is $10^{14}$ Ω·cm or more and the material can be formed into the intermediate transfer belt 24.

As illustrated, the transferred sections 25 are made of a high-resistance material with volume resistivity of $10^{14}$ Ω·cm or more. Therefore, after the charge on the surface of the photosensitive drum 12*a* is transferred to the transferred sections 25, the transferred charge is held without being moved, and the charge can be used as the electrostatic belt indexes 32.

(Configuration of Second and Subsequent Image Forming Units)

Figure 5A:
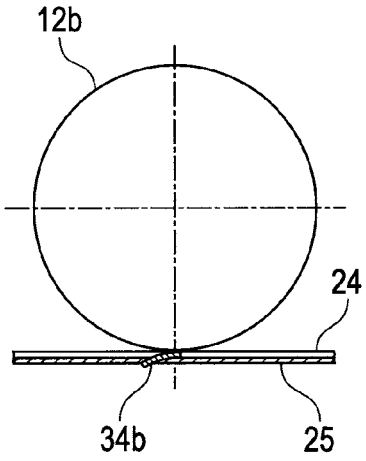
FIG. 5A illustrates an arrangement of a potential sensor that detects electrostatic latent image indexes of the second image forming unit of the first embodiment of the present invention.
Figure 5B:
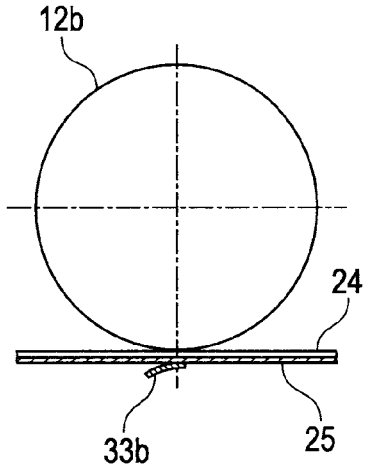
FIG. 5B illustrates an arrangement of a potential sensor that detects belt indexes.

The configurations of the second to fourth image forming units 43*b* to 43*d* will be illustrated. Since the second to fourth image forming units 43*b* to 43*d* all have the same configurations, only the configuration of the second image forming unit 43*b* will be illustrated. FIG. 4 illustrates the second image forming unit 43*b* as seen from the upstream side in the transport direction. FIG. 5A illustrates the second image forming unit 43*b* as seen from a direction illustrated by an arrow B. FIG. 5B illustrates a cross section A-A of FIG. 4. The primary transfer roller 4*b* is not illustrated in FIGS. 5A and 5B.

(Detection of Electrostatic Latent Image Indexes 31*b* and 32 of Drum and Belt)

The photosensitive drum 12*b* with the same shape as in the first image forming unit 43*a* is used in the second image forming unit 43*b*. Belt index read sensors 33*b* are arranged inside of the intermediate transfer belt 24 in the second image forming unit 43*b*, and the electrostatic belt indexes 32 based on the electrostatic latent image transferred to the transferred sections 25 are detected from the back side of the intermediate transfer belt 24.

As illustrated in FIG. 4, the electrostatic latent image index lines 31*b* formed by the second image forming unit 43*b* at the same time as the formation of the image, just like in the first image forming unit 43*a*, are formed in exposure ranges out of the ends of the intermediate transfer belt 24 at both side ends of the second photosensitive drums 12*b*. The electrostatic latent image index lines 31*b* are arranged closer to the ends than the electrostatic latent image index lines 31*a*, and the relationship is similar to the relationship between electrostatic latent image read sensors 34*b* as first detection units and the belt index read sensors 33*b* as second detection units.

The electrostatic latent image read sensors 34*b* and the belt index read sensors 33*b* are arranged at side ends in a direction intersecting the movement direction and at height positions illustrated in FIGS. 5A and 5B. More specifically, in FIG. 5A, the photosensitive drum 12*b* and the intermediate transfer belt 24 come in contact on a transfer position transfer line below the photosensitive drum 12*b*, and the toner image is transferred. The electrostatic latent image read sensor 34*b* is arranged at a position extending the transfer position transfer line in the photosensitive drum axial direction. The belt index read sensor 33*b* is arranged at a position extending the transfer position transfer line, on which the photosensitive drum 12*b* and the intermediate transfer belt 24 come in contact below the transferred section 25 in FIG. 5B to transfer the toner image, in the photosensitive drum axial direction.

Therefore, the belt index read sensors 33*b* and the electrostatic latent image read sensors 34*b* are arranged on the same transfer line in the second image forming unit 43*b*. The belt index read sensors 33*b* and the electrostatic latent image read sensors 34*b* can simultaneously read the electrostatic latent image index lines 31*b* and the electrostatic belt indexes 32 to measure the detection time difference. The same applies to the third image forming unit 43*c* and the fourth image forming unit 43*d*. The electrostatic latent image read sensors 34*b* to 34*d* are the first detection units, and the belt index read sensors 33*b* to 33*d* are the second detection units.

(Time Difference Detection by Two Potential Sensors Arranged on the Same Transfer Line)

As illustrated in FIGS. 5A and 5B, the belt index read sensors 33 and the electrostatic latent image read sensors 34*b* are arranged on the same transfer line and can simultaneously read the electrostatic latent image index lines 31*b* and the electrostatic belt indexes 32 to measure the detection time difference.

The electrostatic latent image index read sensors 34 and the belt index read sensors 33 used in the present embodiment are potential sensors 330 that can detect a change in the potential. A basic configuration of the potential sensors 330 is illustrated in detail in Japanese Patent Application Laid-Open No. H11-183542. Therefore, only parts specific to the present embodiment will be illustrated.

Figure 6A:
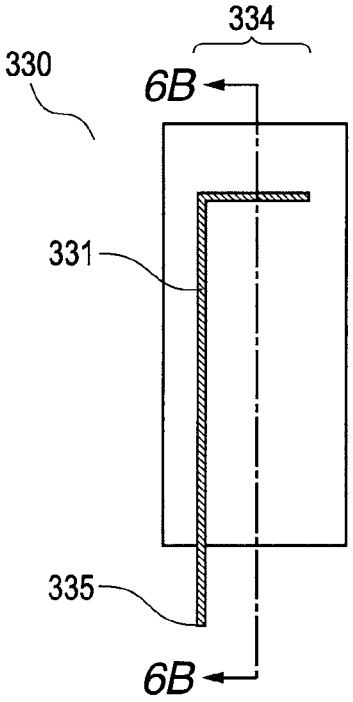
FIG. 6A is a plan view illustrating a configuration of a potential sensor that detects electrostatic latent image indexes.
Figure 6B:
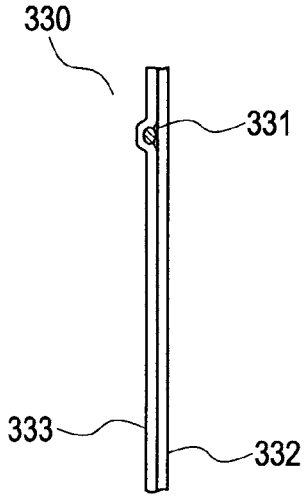
FIG. 6B is a side view illustrating the configuration of the potential sensor.
Figure 7A:
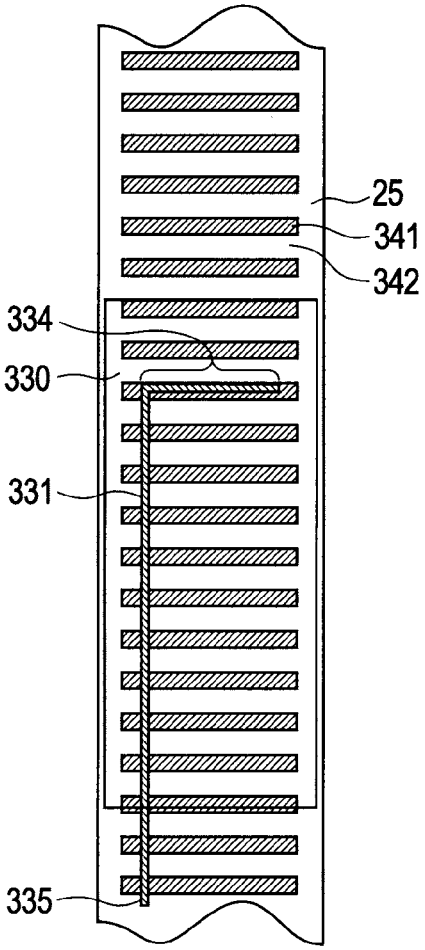
FIG. 7A is a plan view illustrating a positional relationship when the potential sensor reads index lines by a charge.

FIG. 6A illustrates a configuration of the potential sensor 330 used in the present embodiment. FIG. 6B illustrates a cross section 6B-6B of FIG. 6A. As illustrated in FIG. 6A, a lead wire 331 made of a metal wire with a diameter of 20 μm is bent in an L shape. A tip of the lead wire 331 serves as a detection section 334, and the length of the detection section 334 is about 2 mm. When the potential sensor 330 is used as the electrostatic latent image index read sensor 34 or the belt index read sensor 33, the potential sensor 330 is fixed so that the detection section 334 and the index lines formed by the charge are parallel as illustrated in FIG. 7A.

An adhesive is applied to a base film 332 made of a polyimide film with width 4 mm, height 15 mm, and thickness 25 μm. After the application, the lead wire 331 bent in the L shape is arranged, and a protection film 333 made of a polyimide film with equivalent size and thickness as the base film 332 is adhered over the lead wire 331. Although not illustrated in FIG. 6B, the adhesive mainly exists between the base film 332 and the protection film 333. The adhesive does not exist between the lead wire 331 and the base film 332 or between the lead wire 331 and the protection film 333.

Figure 7B:
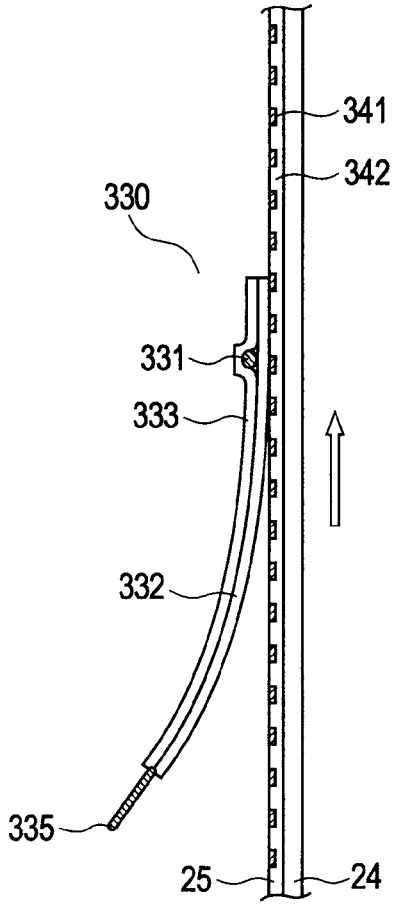
FIG. 7B is a side view when the potential sensor reads the index lines by the charge.

The distance between the surface of the lead wire 331 and the surface of the base film 332 or the protection film 333 is 25

μm. An end opposite the detection section 334 of the L-shaped lead wire 331 is an output section 335 of a signal. FIG. 7B illustrates a layout drawing when the potential sensor 330 is used as the belt index read sensor 33. To bring the base film 332 side of the lead wire 331 in contact with the transferred section 25, the potential sensor 330 is curved as illustrated in FIG. 7B, and a support portion (not illustrated) arranges the potential sensor 330.

In this case, the lead wire 331 may be pressed by a spring from above the protection film 333 so that the interval between the lead wire as the detection section 334 and the transferred section 25 becomes constant. In FIG. 7A, areas of high-potential sections 341, in which the potential transferred to the transferred section 25 is relatively high, are illustrated by hatching, and areas of low-potential sections 342 with relatively low potential are illustrated without hatching.

Figure 8A:
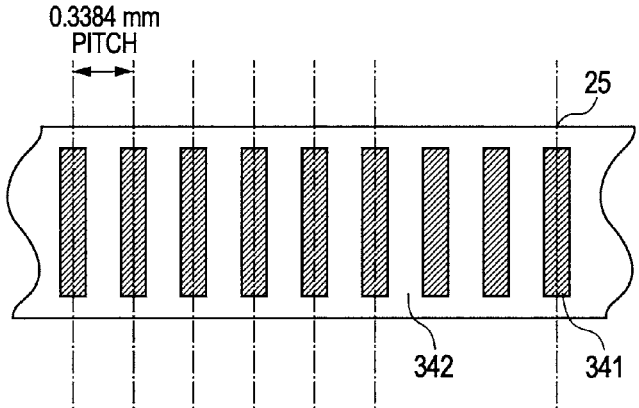
FIG. 8A illustrates indexes with a pitch of 0.3384 mm formed by the charge at a transferred section.

An output from the potential sensor 330 will be illustrated with reference to FIGS. 8A to 12. FIG. 8A is a diagram illustrating a distribution of the high-potential sections 341 and the low-potential sections 342 of the electrostatic belt indexes 32 based on the charge transferred to the transferred section 25. As mentioned above, in the present embodiment, the surface potential of the part where the exposed section on the photosensitive drum is transferred is about 400 V, and the surface potential of the part where the non-exposed section is transferred is about +300 V.

FIG. 8A illustrates latent image indexes formed by repeating exposed sections of eight lines/eight spaces and non-exposed sections of eight lines at an image resolution of 1200 dpi. The intervals of the latent image indexes area are at a 0.3384 mm pitch, which is 16 times the pixel pitch of 0.02115 mm at 1200 dpi.

Figure 8B:
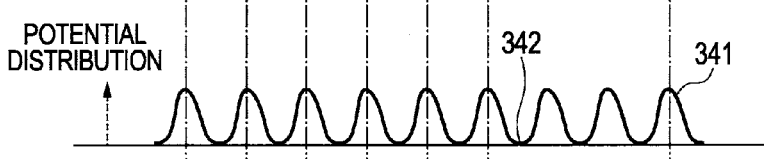
FIG. 8B illustrates a potential distribution of the transferred section.
Figure 8C:
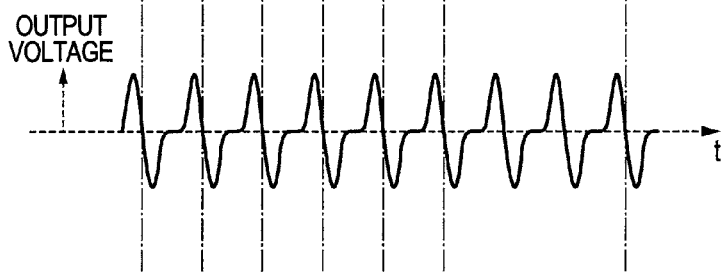
FIG. 8C illustrates output voltages when the indexes are detected.

Since the amount of light exposure by the laser has a distribution and the amount of light exposure decreases at surrounding parts, the actual potential distribution does not form a clean rectangular wave and is a distribution as illustrated in FIG. 8B. In an area with the potential distribution as illustrated in FIG. 8B. If the potential sensor 330 is moved in a direction where the potential changes, an induced current is generated at the detection section 334 of the potential sensor as a result of a change in the potential of the neighborhood. As illustrated in FIG. 8C, an output voltage of the output section 335 of the potential sensor 330 is output as a signal of waveform derived from the potential distribution of FIG. 8B.

It can be specified that a point at a peak tilt 0 in the potential distribution of FIG. 8B is the center of the indexes and that time when the output voltage is 0 in FIG. 8C is the time of the detection of the index lines by the charge.

The pitch of the latent image indexes is rough in FIG. 8C, and there is some time interval between the generation of the potential change and the generation of the next potential change. Therefore, the output signal from the potential sensor has a shape different from a sine wave. If the pitch of the latent image indexes is halved to 0.1692 mm, i.e. four lines/four spaces, as illustrated in FIG. 9A, the potential distribution is as illustrated in FIG. 9B, and the potential sensor output indicates a sine wave as in FIG. 9C.

If the pitch of the latent image indexes is further reduced to one line/one space with a 42.3 μm pitch, which is the smallest pitch that can be realized by the image resolution of 1200 dpi, the relationship between the sizes of the detection section 334 and the latent image indexes is as illustrated in FIG. 10. The width 10 μm of the detection section 334 is a size smaller than half the width 21.15 μm of one line of the latent image indexes. Therefore, the potential sensor 330 of the present embodiment can detect up to the latent image indexes with the minimum pitch that can be realized at 1200 dpi, and the signal output indicates a sine wave.

As in the description of FIG. 8C, it can be specified that the time when the output voltage of the potential sensor 330 is 0 is the time of the detection of the index lines based on the charge. Therefore, the potential sensor according to the present embodiment can detect the latent image indexes with a pitch of 42.3 μm.

Figure 11:
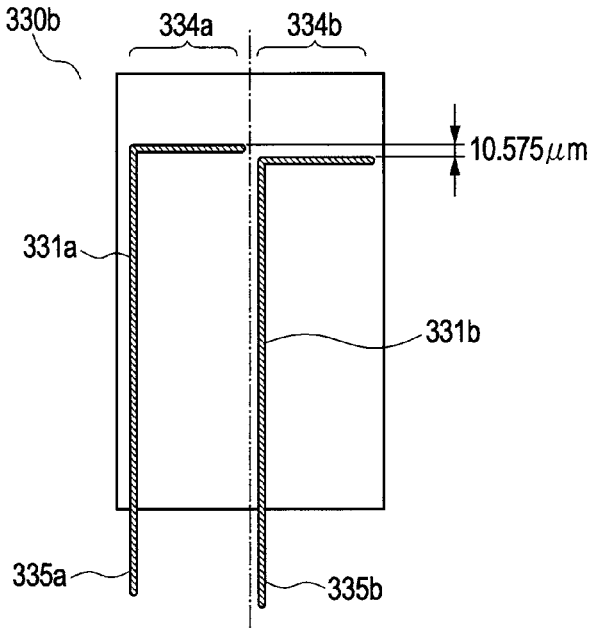
FIG. 11 illustrates a state in which a potential sensor includes two detection sections, and a phase is shifted by 90°.
Figure 12:
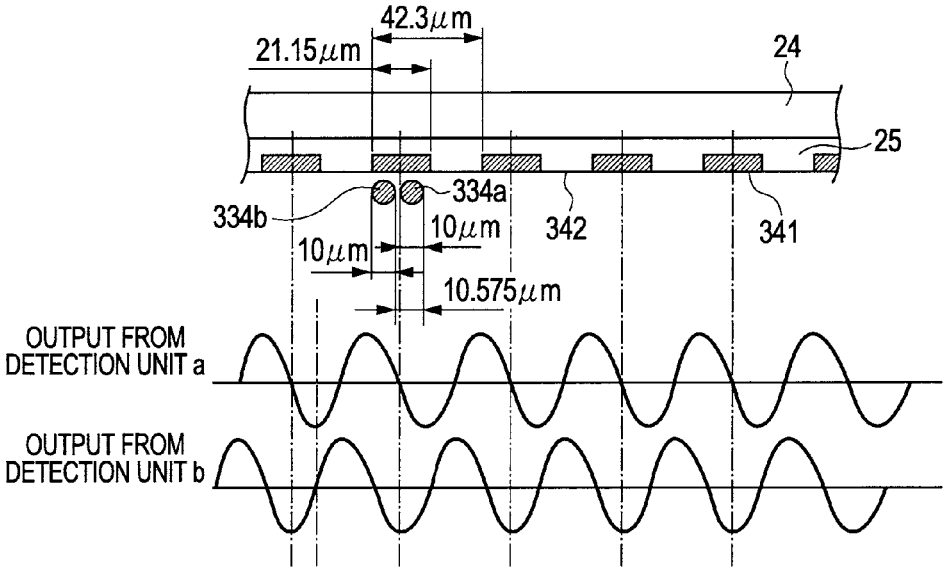
FIG. 12 illustrates a size and an output waveform when the potential sensor includes two detection sections, the phase is shifted by 90°, and indexes with a pitch of 0.0423 mm are detected by the charge.

To read the latent image indexes at high resolution, a potential sensor b 330*b* as illustrated in FIG. 11 may be used, in which a lead wire a 331*a* and a lead wire b 331*b* are arranged, and a detection section a 334*a* and a detection section b 334*b* are shifted by 10.575 μm in the transport direction. In FIG. 11, the detection section is arranged by shifting the phase by ¼, i.e. 90°, of 42.3 μm that is the minimum latent image index pitch, and two outputs with the phase shifted by 90° can be obtained in the output signal of output sections 335*a* and 335*b* as illustrated in FIG. 12. As illustrated in FIG. 12, the signal can be electrically divided if the sine wave with the phase shifted by 90° is used.

As for the method of electrical division, a known method described in Japanese Patent Application Laid-Open No. 2003-161645 can be used without using any new method. Dividing the pitch into 16 parts can be easily realized, and dividing the pitch into 64 parts can also be easily realized. As a result, an index signal of 42.3/64=0.66 μm pitch can be obtained, and a signal with resolving power enough to adjust the position in μm can be obtained.

As illustrated, the use of the potential sensor 330 that detects the potential change can measure, with a sufficiently high precision, the latent image indexes based on the potential distribution. Although the case in which the potential sensor 330 measures the potential distribution of the transferred section 25 has been illustrated, the same applies to a case in which the electrostatic latent image index read sensor 34*b* to 34*d* formed by the potential sensor 330 reads the electrostatic latent image index lines 31*b* to 31*d* formed at the end of the photosensitive drums 12*b* to 12*d*.

(Image Positioning Operation)

Figure 13:
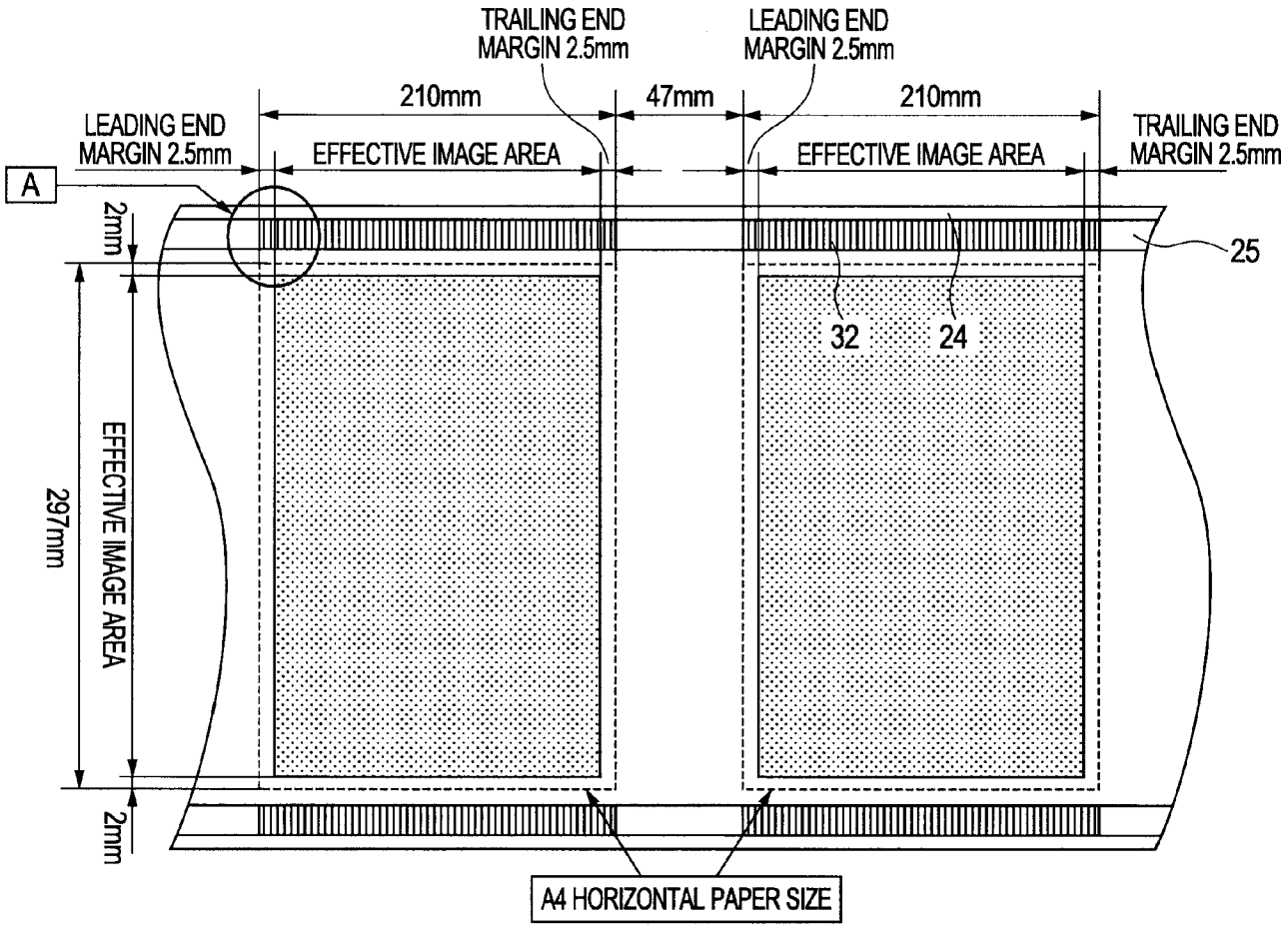
FIG. 13 illustrates an arrangement when toner images and electrostatic belt indexes are transferred to an intermediate transfer belt.
Figure 14:
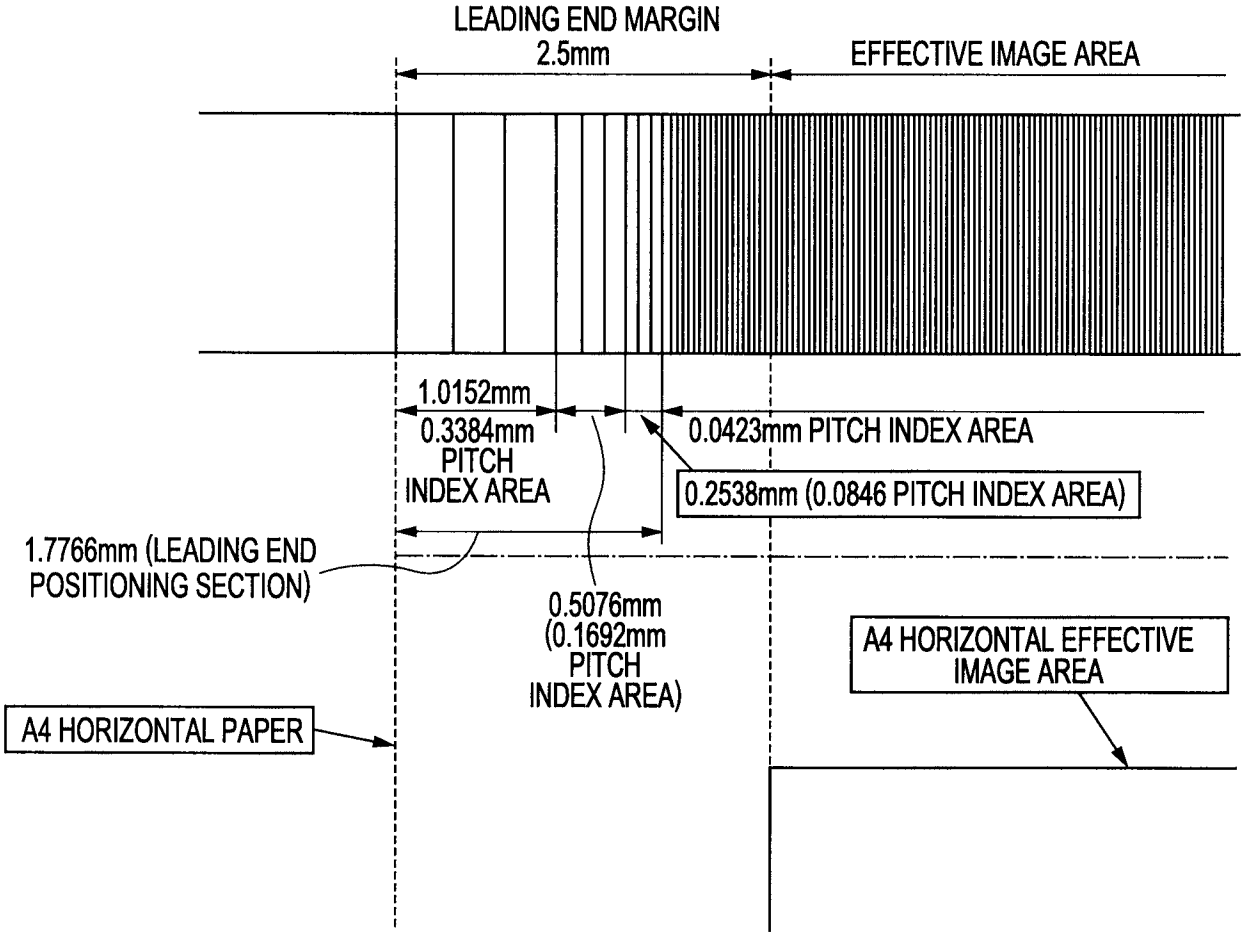
FIG. 14 illustrates a configuration of electrostatic belt indexes at the leading end of a page in the arrangement when the toner images and the electrostatic belt indexes are transferred to the intermediate transfer belt.

An operation of actual image positioning, i.e. index matching by the second image forming unit 43*b* and subsequent image forming units, will be illustrated with reference to FIGS. 13 to 18. FIG. 13 illustrates a positional relationship and a configuration between toner images that are transferred to the intermediate transfer belt by the first image forming unit 43*a* and that are to be transferred to recording paper of an A4 horizontal size and the electrostatic belt indexes 32 transferred to the transferred sections 25. FIG. 14 is a partially enlarged view illustrating a configuration of the electrostatic belt indexes at the leading end of the image indicated by a section A of FIG. 13.

FIG. 13 illustrates a state, in which consecutive two pages of toner images of images (effective image areas) formed by the first image forming unit 43*a* on an A4 horizontal sheet and the electrostatic belt indexes 32 are transferred to the intermediate transfer belt 24. In the transfer of the toner images from the photosensitive drums to the intermediate transfer belt and further from the intermediate transfer belt to the recording sheet, about 0.5% of speed difference is generally set to slide the toner images to perform the operation of transferring. However, to simplify the description, it is assumed in the present embodiment that the amount of slide in the transport direction is zero and that toner images with the same size as the toner images after the transfer to the recording sheet are formed on the photosensitive drums and the intermediate transfer belt.

The image formation is not possible over the entire surface of the A4 horizontal recording paper, and the images are formed with margins on the leading end, trailing end, left, and right of the recording sheets. In the present embodiment, the leading end and trailing end margins are 2.5 mm, and the left and right margins are 2 mm as illustrated in FIG. 13. When forming an image of one page on the photosensitive drum 12*a* of the first image forming unit 43*a*, an exposure operation is started from the section corresponding to the leading end of the recording paper, and the formation of the electrostatic latent image indexes 31 is started at both ends of the photosensitive drum 12*a* from the section 2.5 mm from the area for forming the toner image.

In the present embodiment, the image forming apparatus has an image resolution of 1200 dpi, and the pitch of the laser light for exposure is 0.02115 mm based on 25.4 mm/1200=0.02116666 . . . . To form the electrostatic latent image index lines 31*a*, the indexes have the minimum pitch in the case of one line/one space which repeats exposure/non-exposure every line, and the minimum index pitch of the present embodiment is 0.02115×2=0.0423 mm.

Therefore, the electrostatic latent image index lines 31*a* in the area for forming the toner image form indexes with a pitch of 0.0423 mm which is the minimum pitch that can be formed in one line/one space. As illustrated, due to the potential sensor 330*b* with the phase shifted by 90° which reads the indexes of 0.0423 mm, indexes with a pitch of 0.66 μm can be used in the present embodiment.

In the present embodiment, an exposure operation is performed to form indexes with a pitch greater than that in the effective image area at the leading end margin in the image formation of one page, in order to surely perform the index matching at the leading end by the second and subsequent image forming units. FIG. 14 is an enlarged view of the section A of FIG. 13 and illustrates electrostatic latent image indexes formed on the margin section at the leading end of the image (leading end margin). In FIG. 14, index lines are formed at a section corresponding to the leading end of the margin so that the intervals sequentially increase toward the leading end, and rough adjustments can be sequentially shifted to fine adjustments in the movement direction.

Specifically, four indexes are first formed with a pitch of 0.3384 mm equivalent to eight times 0.0423 mm that is the index pitch of the effective image area. The pitch is halved to form three index lines at a pitch of 0.1692 mm. The pitch is further halved to form three indexes with a pitch of 0.08846 mm. Indexes are then formed with a pitch of 0.0423 mm which is the same as the pitch formed in the effective image area, and electrostatic latent image indexes are formed with a pitch of 0.0423 mm up to the area of the trailing end margin.

As illustrated in FIG. 14, the area for forming the index pitch greater than the index pitch of the image forming unit is obtained based on the following formula.

The length of the area is 0.3384×3+0.1692×3+0.0846×3=1.0152+0.5076+0.2538=1.7766 mm, which is an area shorter than the leading end margin. The second image forming unit 43*b* and subsequent image forming units also start forming the index pitch of the leading end margin from the index pitch eight times the index pitch of the effective image area and gradually narrows the pitch to four times and two times to connect the indexes to the indexes with the minimum pitch. In the conventional electrophotographic apparatus, an image position deviation of about 100 to 150 μm is occurred. Therefore, the positions of the drum latent image indexes at the transfer position of the second image forming unit are deviated by about 150 μm at the maximum relative to the electrostatic belt indexes transferred by the first image forming unit.

After the detection of the latent image index of one of the drum and the belt, the latent image index of the other one is always detected, and corresponding indexes are alternately detected. Therefore, control units 100*b* to 100*d* control the rotational speeds of the photosensitive drums 12*b* to 12*d* to match the latent image indexes 31*b* to 31*d* of the drum with the positions of the latent image indexes 31*a* transferred to the belt, every time the latent image indexes 31*b* to 31*d* of the drum are detected. The gradual reduction of the index pitch at the leading end margin can continue the positioning without losing the corresponding indexes up to the effective image area.

The electrostatic latent image index lines are formed with a pitch of 0.0423 mm in the effective image area, and the potential sensor can confirm that the deviation in the effective image area is within the tolerance. If the deviation is large, the rotational speeds of the photosensitive drums 12*b* to 12*d* are controlled to reduce the deviation.

Figure 15:
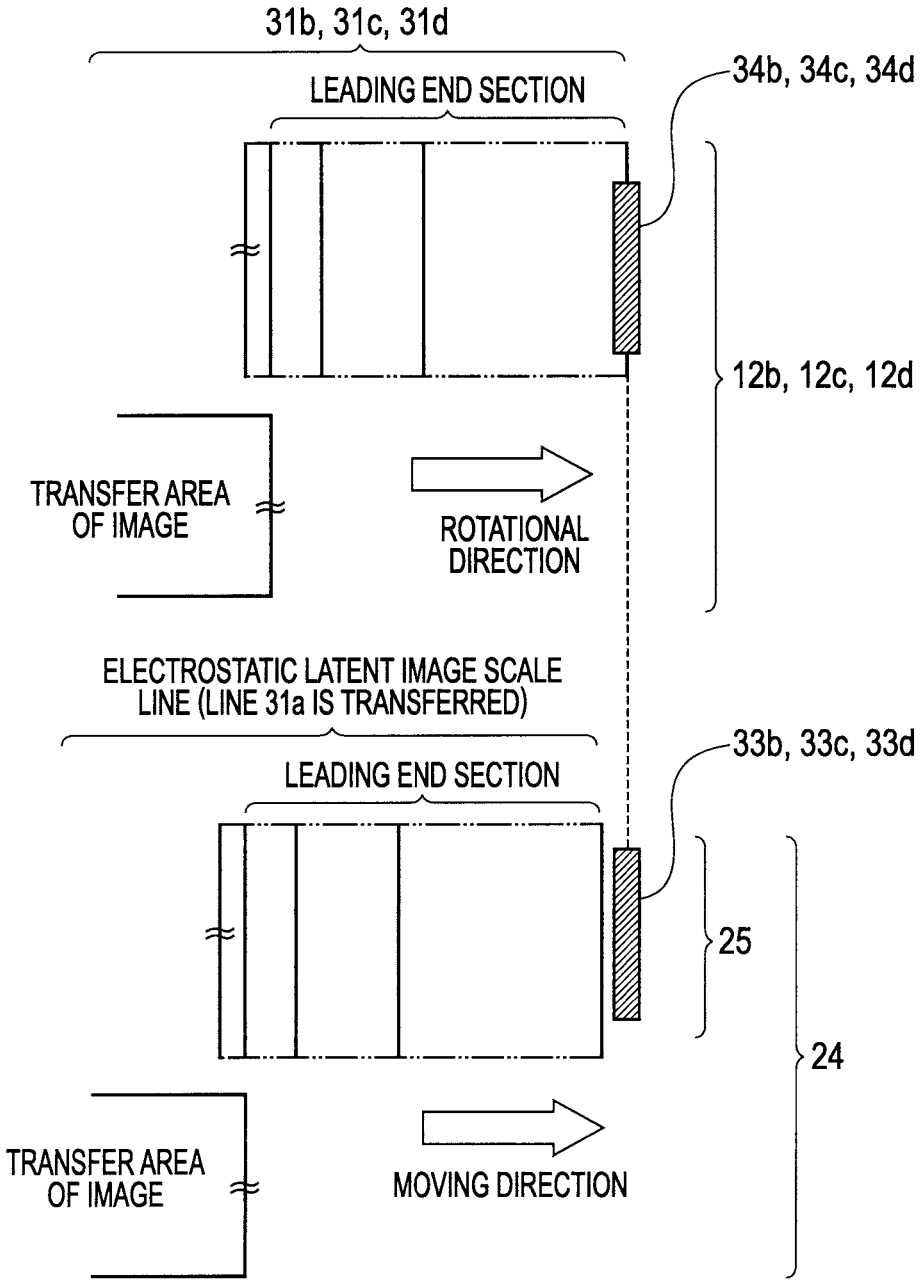
FIG. 15 illustrates an overall configuration of detecting electrostatic latent images of the photosensitive drums and the intermediate transfer belt and measuring a detection time difference.
Figure 18:
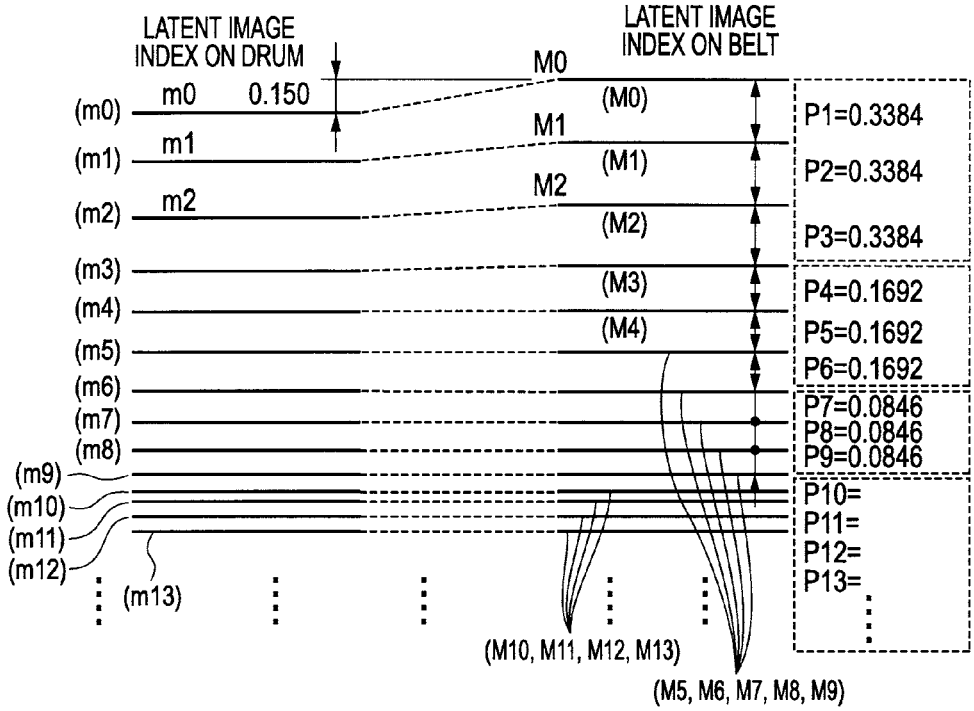
FIG. 18 illustrates an index matching operation of the first embodiment of the present invention.

FIG. 15 illustrates an overall configuration of measuring the detection time difference by detecting the electrostatic latent images of the photosensitive drum and the intermediate transfer belt. FIG. 18 illustrates an image of index matching when the leading end of the drum latent image indexes is deviated by 0.150 mm relative to the belt latent image indexes. The index at the leading end is deviated by only about 150 μm at the most. Therefore, it is assumed that indexes m0 and M0 at the leading end are deviated by 0.150 mm in FIG. 18. To match the next indexes, the rotational speed of the photosensitive drum drive motor is changed based on the results of reading the index positions, and the photosensitive drum is operated to match the next indexes m1 and M1. However, the positioning error is too large, and the next indexes m1 and M1 are not completely matched.

The index positions can be substantially matched by controlling the rotation to match indexes m2 and M2 as well as m3 and M3. The positions of the drum latent image indexes and the belt latent image indexes can be continuously matched even as the index pitch is gradually reduced. The same applies even if the length of the index pitch is reduced to the minimum 0.0423 mm. This can bring the drum latent image indexes in line with the belt latent image indexes at the leading end margin. Therefore, the toner images can be continuously transferred with small color deviations in the second and subsequent image forming units relative to the toner image transferred from the drum to the belt in the first image forming unit.

Figure 16:
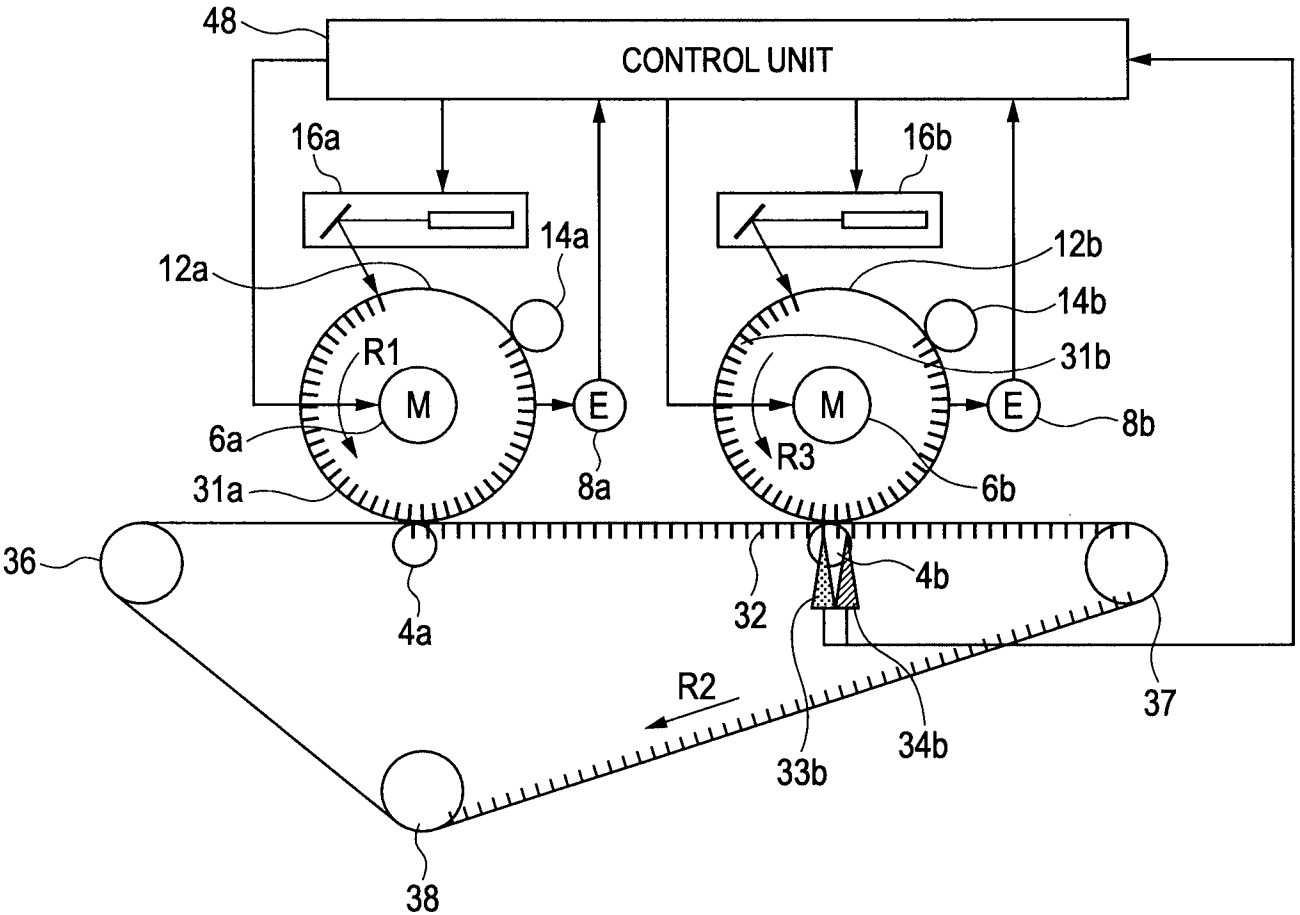
FIG. 16 illustrates a control block of the first embodiment of the present invention.
Figure 17:
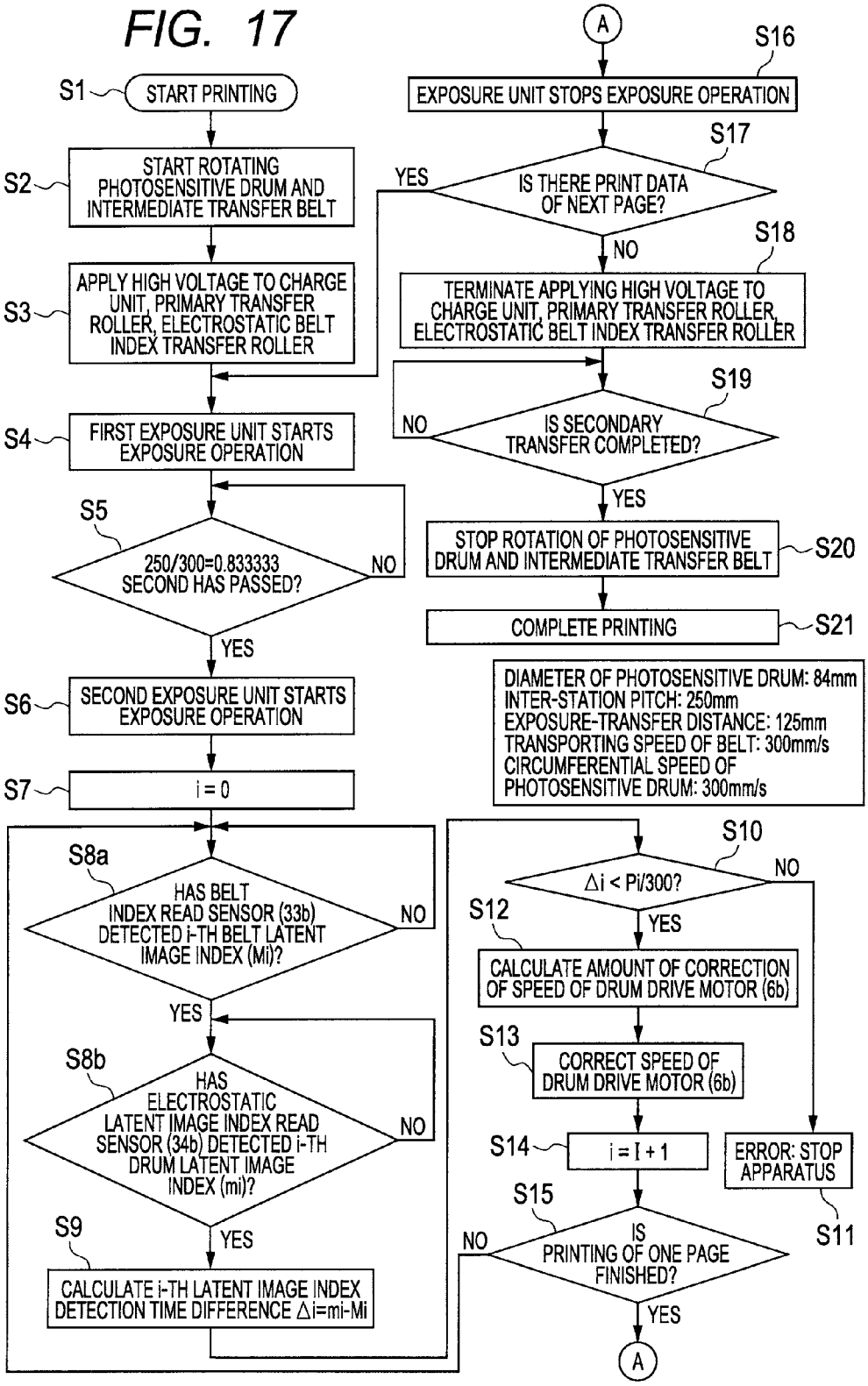
FIG. 17 is a flow chart illustrating an operation of the first embodiment of the present invention.

FIG. 16 illustrates a control block of the first embodiment. FIG. 17 is an operational flow chart illustrating the content of the control. Since configurations of the second and subsequent image forming units are the same, only the second image forming unit is illustrated in FIG. 16. An operation of image forming and image positioning according to the present embodiment will be illustrated with reference to the flow chart of FIG. 17. In the present embodiment, a control section 48 of FIG. 16 has a function as a control section that performs an operation of image positioning and has a function as a start operation control section that starts positioning the electrostatic belt index at the leading end margin and the electrostatic latent image index at the leading end margin.

In step S1, when the control section 48 receives a print start signal, the control section 48 provides a rotation start instruction to the drum drive motors 6*a* and 6*b* and a belt drive motor (not illustrated). The control section 48 controls the rotations of the drum drive motors 6*a* and 6*b* at a constant speed while reading the signals of the drum encoders (E) 8*a* and 8*b* directly connected to the drum drive axis to rotate the photosensitive drums 12*a* and 12*b* in arrow R1 and R3 directions at a constant speed. Similarly, the control section 48 drives the rotations of the belt drive motor (not illustrated) at a constant speed based on a signal of a belt drive roller encoder attached to the axis of the belt drive roller 36. The control section 48 rotates the intermediate transfer belt 24 wound around the belt drive roller 36 in an arrow R2 direction at a constant speed (step S2).

In step S3, it is started to apply a predetermined high voltage to the charge units 14*a* and 14*b*, the primary transfer rollers 4*a* and 4*b*, and the electrostatic belt index transfer roller 47, and the surfaces of the photosensitive drums 12*a* and 12*b* are charged at −600 V in the present embodiment. In step S4, when the control section 48 receives an image signal, the first exposure unit 16*a* starts an exposure operation, and the electrostatic latent image indexes 31*a* are formed at a predetermined pitch from the section corresponding to the leading end margin as illustrated in FIGS. 13 and 14. When the exposure operation of image data is started, the exposure operation is continued until the end of the electrostatic latent image indexes 31*a* and the image data of one page.

In step S5, the first exposure unit 16*a* determines whether 0.8333333 second has elapsed since the start of the exposure operation. In step S6, the second exposure unit 16*b* starts an exposure operation. In the present embodiment, the diameter of the photosensitive drum is 84 mm, and the inter-station pitch between the first image forming unit 43*a* and the second image forming unit 43*b* is 250 mm. The exposure-transfer distance from the exposure position on the photosensitive drum surface to the position for transferring the toner image to the intermediate transfer belt is set to 125 mm. The belt transport speed and the circumferential speed of the photosensitive drum are set to 300 mm/s.

The timing of writing the latent image to the photosensitive drum 12*b* is as follows. More specifically, writing is performed by delaying by the length of time of the transport of the intermediate transfer belt 24 from the position of transfer from the photosensitive drum 12*a* to the intermediate transfer belt 24 in the image forming unit 43*a* on the upstream side to the position of transfer from the photosensitive drum 12*b* to the intermediate transfer belt 24 in the next image forming unit 43*b*. As a result, the time interval from the start of image forming in the first image forming unit 43*a* to the start of image forming in the second image forming unit is calculated by 250 mm 300 mm/s, which is 0.8333333 second.

In step S7, i is set to 0. There is no positional deviation in the toner images superimposed and formed on the intermediate transfer belt if there is no speed fluctuation in the photosensitive drums 12*a* and 12*b*, there is no speed fluctuation in the intermediate transfer belt 24, and the images are always transported between the transfer positions at a constant time interval. The image positional deviation is occurred if there is unevenness in the speed of the intermediate transfer belt due to eccentricity of the belt drive roller or unevenness in the thickness of the intermediate transfer belt or if there is a speed fluctuation in the photosensitive drum drive motor or the belt drive roller drive motor.

The eccentricity of the belt drive roller and the thickness unevenness of the intermediate transfer belt can be measured in advance to correct the speed unevenness. As for the speed fluctuation of the motors, the speed can be corrected with the encoders attached to the same axis.

However, there is a problem of expansion and contraction of the intermediate transfer belt 24 caused by tension fluctuation occurred in the image forming units and occurred in the intermediate transfer belt 24 due to a difference in the amounts of toner transferred in the image forming units. More specifically, the expansion and contraction of the intermediate transfer belt 24 vary depending on the image and cannot be predicted because the expansion and contraction are changed by values such as the amount of transferred toner and the primary transfer voltage determined by the process conditions. Therefore, it is significantly difficult to correct the expansion and contraction. The tension fluctuation changes the time until the toner image on the intermediate transfer belt 24 transferred by the image forming unit on the upstream side reaches the image forming unit on the downstream side.

The color deviation occurs by the amount of the fluctuation time. In the present embodiment, the color deviation can be prevented even if there is an unexpected speed fluctuation of the intermediate transfer belt 24. More specifically, the color deviation is prevented by controlling the rotation of the drum drive motor 6*b* connected to the photosensitive drum 12*b* so that the electrostatic image index lines 31*b* match the corresponding electrostatic belt indexes 32 at the transfer position.

In steps S8*a* and S8*b*, the belt index read sensor 33*b* or the electrostatic latent image index read sensor 34*b* first detects an i-th (i=0) latent image index of one of the latent image indexes on the belt and the drum. As illustrated in relation to FIGS. 13 and 14, the index pitch of the leading end margin is enlarged eightfold, or 0.3384 mm. Therefore, as illustrated in FIG. 18, the other latent image index would be detected before detecting an i-th (i=1) latent image index on the latent image index belt or drum following the one of the latent image indexes.

In step S9, a time difference Δi in the detections of the latent image indexes at the leading ends of the drum and the belt is calculated. In step S10, Δi is compared with a value obtained by dividing an index pitch Pi by the transport speed 300 mm/s. If Δi is smaller than the value of Pi/300, the other latent image index is detected before detecting the second latent image indexes. Therefore, which indexes can be matched can be clearly determined.

If Δi is greater than the value of Pi/300, that is a case in which the other latent image index cannot be detected before the second latent image indexes are detected. Therefore, which indexes need to be matched cannot be determined. In the present embodiment, the pitch of the formed latent image indexes is large in the margin area of the image leading end section, and the leading end latent image indexes can be alternately detected in a normal state.

If the load imposed on the intermediate transfer belt increases for some reason, and there is a large slide between the belt drive roller and the intermediate transfer belt, the leading end latent image indexes cannot be alternately detected. In that case, an error is determined in step S11, and the operation of the apparatus is stopped.

In step S12, based on Ai calculated in step S9, the amount of correction of the speed of the drum drive motor 6*b* of the second image forming unit 43*b* is calculated to eliminate the positional deviation in the latent image indexes of the photosensitive drum and the intermediate transfer belt. In step S13, the rotational speed of the drum drive motor 6*b* is corrected, and the index pitch is converged to the minimum pitch before reaching the effective image area (S14). At the same time, the rotational speed of the drum drive motor is controlled and corrected to reduce the positional deviation between the indexes. This is repeated until the end of the image data of one page, and the exposure operation is terminated when the image data of one page is finished in step S15 (step S16).

If there is print data of the next page (step S17), the process returns to step S4, and a similar operation is repeated to form images while positioning the images. If the print data is finished, the application of high voltages of the charge units, the primary transfer roller high voltage units, and the latent image index transfer high voltage units is terminated (step S18). The photosensitive drums and the intermediate transfer roller continue to rotate until the secondary transfer to the recording sheet is finished (step 19). If it is determined that the secondary transfer of all image data is finished, the drive motors of the photosensitive drums and the intermediate transfer belt are all terminated (step S20), and the print operation is finished (step S21).

Based on the illustrated configuration, the positions of the electrostatic latent image index lines 31 corresponding to the toner images in the second image forming unit 43*b* and subsequent image forming units are matched with the electrostatic belt indexes 32 corresponding to the toner image transferred by the first image forming unit 43*a*. The second image forming unit 43*b* and subsequent image forming units can highly accurately superimpose and transfer the toner images on the toner image formed on the intermediate transfer belt 24. Therefore, a color toner image without color deviation can be obtained.

The color toner image formed on the intermediate transfer belt 24 is transported to a second transfer section 44 illustrated in FIG. 1 and is secondarily transferred to recording paper transported from a paper feeding apparatus (not illustrated) by an electric field applied to the secondary transfer roller 38. The recording paper is transported to a fixing unit (not illustrated) and is discharged outside of the apparatus after fixation of the toner image on the recording paper. The belt cleaning unit 45 scrapes off, from the intermediate transfer belt 24, the toner that is not completely transferred to the recording paper and still attached to the surface of the intermediate transfer belt 24, and the toner is collected in a waste toner box (not illustrated).

In the present embodiment, the potential sensor that reads the potential change in the latent image to change the potential change to a pulse signal reads the latent image indexes corresponding to the toner image to always match the corresponding indexes. In this way, the image position deviation due to the expansion and contraction of the intermediate transfer belt caused by the formation of the toner image on the intermediate transfer belt can be highly accurately corrected. Therefore, an image forming apparatus with little color deviation can be provided.

The potential sensor used in the present embodiment is formed by just arranging lead wire patterns on a flexible substrate. The cost is significantly low, and the potential sensor can read the latent image in itself. Therefore, other writ/read units are not necessary, and errors can be reduced. A more highly accurate, inexpensive image forming apparatus can be provided.

The belt index read sensor that reads the electrostatic belt indexes 32 transferred to the transferred section 25 can be arranged inside the intermediate transfer belt. Therefore, the possibility that the surface becomes dirty due to spatter of toner, etc., is reduced, and a more reliable product can be provided.

In the present embodiment, even a tandem-system color image forming apparatus including a plurality of image forming units for high speed can form latent image indexes on the photosensitive drum by exposure light to form indexes without an error of positional deviation from image. Furthermore, at the same time with the transfer of the developed toner image to the intermediate transfer belt, the latent image indexes formed on the photosensitive drum are transferred to the transferred section of the intermediate transfer belt to form the electrostatic belt indexes by the charge.

Therefore, errors in index writing and errors in reading can be all eliminated. Since there is no influence of temperature fluctuation, the electrostatic belt indexes can be formed for the toner image transferred to the intermediate transfer belt without an error in the sub scanning direction. In the second and subsequent image forming units, electrostatic belt indexes formed without a positional deviation error for the tone image on the intermediate transfer belt and latent image indexes formed without a positional deviation error for the toner images developed on the photosensitive drums can be detected at the transfer positions.

The transfer positions of all photosensitive drums of the second and subsequent image forming units are changed relative to the intermediate transfer belt during the image formation to match the indexes. In this way, the toner images can be transferred with little positional deviation at the transfer positions of the second and subsequent image forming units, relative to the toner image transferred by the first image forming unit. Therefore, a high-quality image with little color deviation can be output.

The belt cleaning unit 45 that cleans up the surface of the intermediate transfer belt by scraping off the toner attached and remained on the surface of the intermediate transfer belt 24 without being transferred to the recording medium in the secondary transfer section 44 is provided around the belt drive roller 36. At both ends of the belt cleaning unit 45, grounded neutralization brushes (not illustrated) are arranged at positions opposing the transferred sections 25 provided on the surface of the intermediate transfer belt 24. The neutralization brushes come in contact with the transferred sections 25 to delete the electrostatic belt indexes 32 transferred to the transferred sections 25.

Alternatively, as illustrated in FIG. 1, an upper corona charger 46*a* and a lower corona charger 46*b* may be arranged, between the belt drive roller 36 and the first photosensitive drum 12*a*, to sandwich the transferred sections 25 on the intermediate transfer belt 24. Therefore, application of an AC voltage of the opposite phase can surely delete the latent image belt indexes 32 of the transferred sections 25.

In the present embodiment, a dedicated index writing unit does not have to be provided as a result of forming the indexes of the photosensitive drum surface by the electrostatic latent image. Therefore, the configuration is simpler, and sections that require adjustment can be reduced. As a result, a more inexpensive high-speed color electrophotographic apparatus can be provided.

The integration of the belt index read sensor and the electrostatic latent image index read sensor can not only reduce the size, but can also form an antenna section on the same flexible substrate. As a result, the drum latent image read positions and the belt latent image read positions can be the same positions in the sub scanning direction in the stations on the downstream side where the positioning is performed. This allows positioning control with few errors. Even if the sensor positions are changed due to vibrations, etc., since the antenna section is formed on the same flexible substrate, there is almost no deviation in the relative positions in the transport direction compared to when the sensors are separately arranged. Therefore, more highly accurate positioning can be realized.

Second Embodiment

Figure 19:
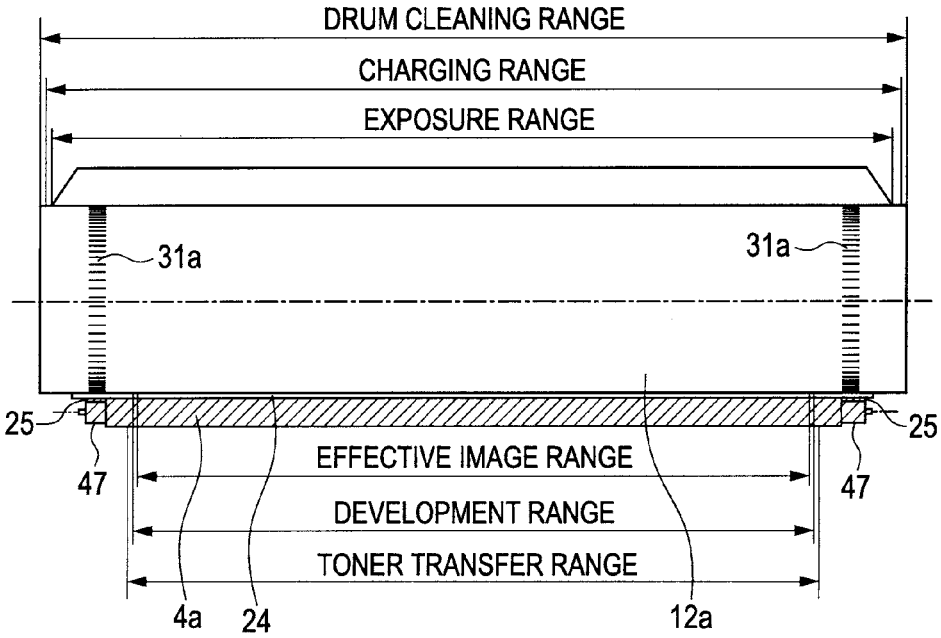
FIG. 19 is a cross-sectional view illustrating a second embodiment of the present invention.

FIGS. 19 to 28 and FIGS. 22 to 26 illustrate a second embodiment. Only parts different from the first embodiment will be illustrated. Differences from the first image forming unit 43*a* are that a cored bar of the primary transfer roller 4*a* and the electrostatic belt index transfer rollers 47 (second transfer members) is shared as illustrated in FIG. 19 and that a high-voltage power supply is shared. In the first embodiment, the primary transfer roller 4*a* and the electrostatic belt index transfer roller 47 are provided with elastic conductive layers made of conductive sponges, etc., around the cored bars of SUS, etc. High voltages for the primary transfer and the index transfer are applied to the cored bars.

Figure 20:
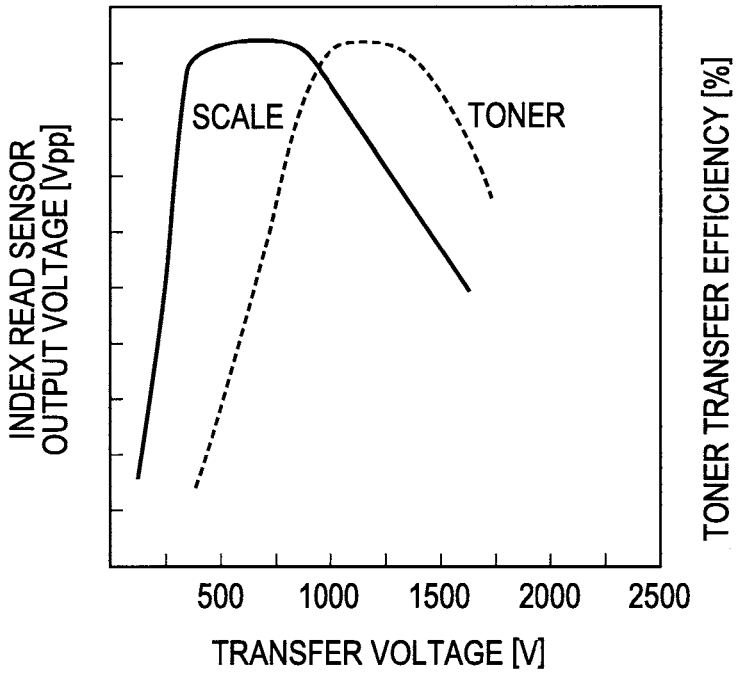
FIG. 20 is an explanatory view illustrating a transfer voltage dependency of toner transfer in an effective image area and a transfer voltage dependency of index transfer outside of the effective image area according to the second embodiment.

FIG. 20 illustrates transfer voltage dependency of toner transfer in the effective image area and transfer voltage dependency of index transfer outside of the effective image area. A broken line denotes the toner transfer, and a solid line denotes the index transfer. The transfers have optimal values, and the optimal values are deviated. A vertical axis on the left denotes amplitude Vpp of the output voltage of the belt index read sensor illustrated in the description of the potential sensor. More specifically, the output of the potential sensor depends on the transfer voltage. The higher the output voltage is, the more excellent is the index transfer, and the belt index read sensor can easily read the index. A vertical axis on the right denotes transfer efficiency of the toner, and the higher the transfer efficiency, the more the amount of toner transfer.

In the toner transfer, the transfer electric field is small if the transfer voltage is low. The force for transferring the toner from the photosensitive drum to the intermediate transfer belt is insufficient, and the toner cannot be transferred. If the transfer voltage is high, the transfer electric field is too large. The electricity is discharged, and the charge polarity of the toner is reversed. The toner with reversed polarity receives the force of the electric field in a direction opposite the direction from the photosensitive drum to the intermediate transfer belt. Therefore, the toner is not transferred and remains on the photosensitive drum.

Similarly, in the index transfer, the transfer electric field is small if the transfer voltage is low. The indexes cannot be transferred from the photosensitive drum to the intermediate transfer belt. A transfer voltage adjustment unit can transfer the indexes from the photosensitive drum to the intermediate transfer belt by Paschen discharge. However, if the transfer voltage is too high, the transfer electric field is too large. The amount of discharge is too much, and the electrostatic indexes are disordered. Therefore, it is known that the reading accuracy in the belt index read sensors in the second and subsequent image forming units is degraded.

The optimal values of the toner transfer and the index transfer are deviated because while the index transfer is performed based on the Paschen discharge, the toner transfer provides, as a transfer electric field, Coulomb force for overcoming image force and non-electrostatic adhesion force of the photosensitive drum and the toner. The index transfer depends on conditions such as resistance values of the photosensitive drum, the intermediate transfer belt, and the transfer roller, and in addition to these, the toner transfer is affected by a shape factor of the toner, application of an additive, etc.

It is known as a common point that there are fluctuations in resistance values of the photosensitive drum, the intermediate transfer belt, and the transfer roller due to endurance, and optimal value fluctuations due to endurance also exhibit the same tendency. Therefore, the cored bars and the high-voltage power supplies of the primary transfer roller and the electrostatic belt index transfer roller can be shared.

The deviation in the optimal values of the transfers requires separate transfer rollers and separate high-voltage power supplies, which leads to an increase in the size of the apparatus and an increase in the cost. Therefore, in the present embodiment, the cored bar is shared to integrate the primary transfer roller 4*a* and the electrostatic belt index transfer rollers 47. The resistances of the elastic conductive layers are changed between the toner transfer section and the index transfer section to match the optimal transfer voltages.

Table 1 illustrates that the optimal transfer voltages are matched by changing the resistance values of the elastic conductive layers of the transfer rollers between the first and second embodiments. More specifically, the resistance values of the elastic conductive layers at the sections of the toner transfer and the index transfer are both 1E6[Ω] in the first embodiment, and the optimal transfer voltages are 1000 [V] and 500 [V], respectively. In the second embodiment, the resistance values of the elastic conductive layers are 1E6[Ω] and 2E7[Ω], respectively, and the optimal transfer voltage is 1000 [V]. In this case, 1E6 denotes 1×10 to the 6 power, and 2E7 denotes 2×10 to the 7 power.

TABLE 1

| | | Effective Image Area (Toner Transfer) | Electrostatic Latent Image Index Area (Index Transfer) |
|---|---|---|---|
| First Embodiment | Transfer Roller Elastic Layer Electrical Resistance Value Rt | 1E6 Ω | 1E6 Ω |
| | Optimal Transfer Value Vt | 1000 V | 500 V |
| Second Embodiment | Transfer Roller Elastic Layer Electrical Resistance Value Rt | 1E6 Ω | 2E7 Ω |
| | Optimal Transfer Value Vt | 1000 V | 1000 V |

The resistance value of the transfer roller is measured as follows by making the transfer roller rotatable, abutting a metal roller to the transfer roller, applying a constant voltage to the cored bar of the transfer roller, and measuring an inflowing current to the abutted metal roller.

Transfer Roller Resistance [Ω]=Applied Voltage [V]/Inflowing Current [A]

Figure 21:
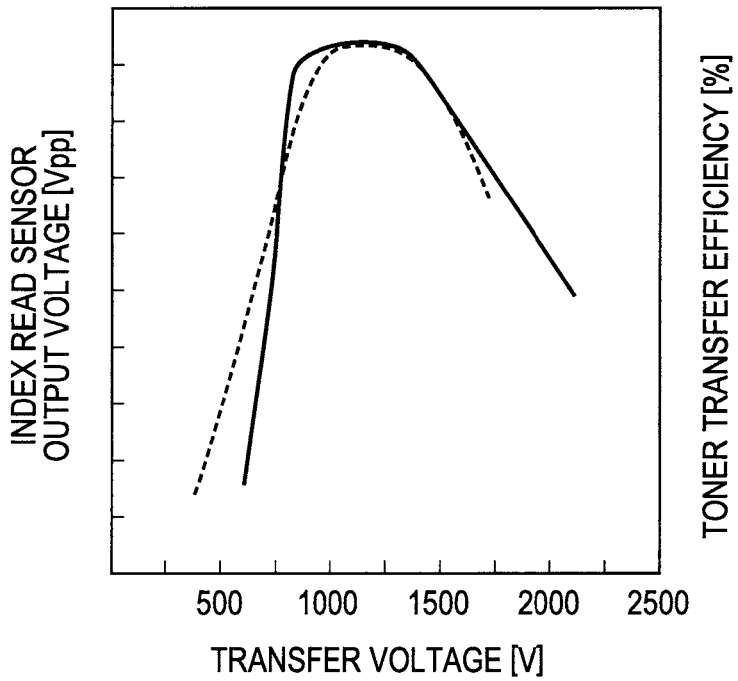
FIG. 21 is an explanatory view illustrating a state in which optimal transfer voltages of the toner transfer and the index transfer match according to the second embodiment.

FIG. 21 illustrates a state in which the optimal transfer voltages of the toner transfer and the index transfer match. Assuming that the resistance value of the elastic conductive layer of the transfer roller in the effective image area toner transfer is Rti, the optimal transfer voltage is Vti, the resistance value of the elastic conductive layer of the transfer roller in the electrostatic latent image index area is Rtm, and the optimal transfer voltage is Vtm, the following formula can be obtained.

$$Vti/Rti=a\cdot Vtm/Rtm \qquad \text{Expression 1}$$

In the formula, a denotes a proportional constant. In the formula, a is a correction factor based on the ratio of the sizes of the index area and the image area, the non-electrostatic adhesion force of the toner, etc., and is a value dependent on design values such as a shape factor of the toner and an additive condition. Although a=20 in the example, the toner transfer and the index transfer both have optimal transfer current values at the application of the optimal transfer voltages.

The toner transfer has a current value combining a current value associated with the movement of the charge according to the amount of charge of the toner and a current value necessary to overcome the non-electrostatic adhesion force to transfer the toner. The index transfer has a current value associated with the movement of the charge forming the electrostatic latent image index, i.e. a current based on the Paschen discharge. Expression 1 indicates that the toner transfer and the index transfer can be excellently performed by setting the resistance values of the elastic conductive layers at the sections of the toner transfer and the index transfer of the transfer roller so that the toner transfer current and the index transfer current have proportional conditions.

The current value is as follows in the second embodiment of Table 1.

$$1000V/1E6\Omega=20\times1000V/2E7\Omega$$

According to the above concept, the optimal transfer current value can be set as the transfer current value to perform the constant current control. However, the image is actually formed based on the presence/absence of the toner in the effective image area, and the transfer current varies between the toner section and the non-toner section. Therefore, the constant voltage control is performed so that the optimal transfer current value flows to the toner section.

Figure 22:
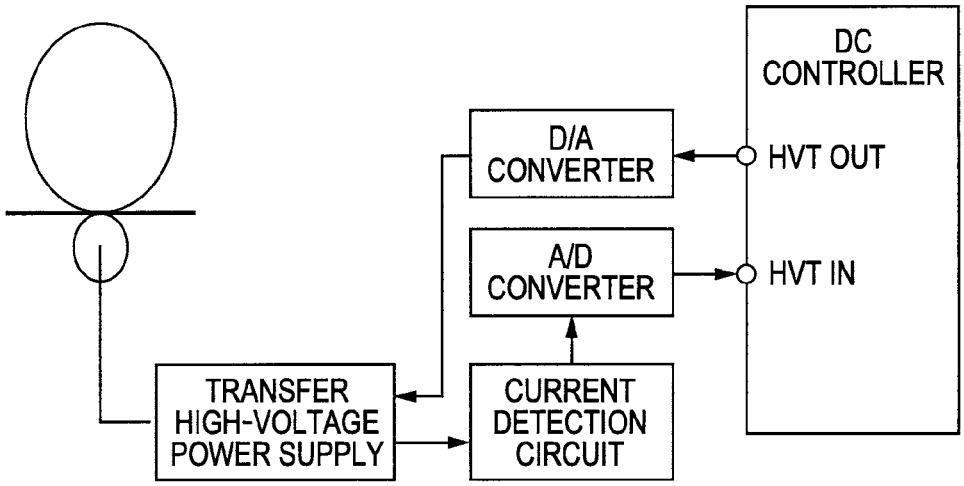
FIG. 22 is a block diagram in ATVC control according to the second embodiment.
Figure 23:
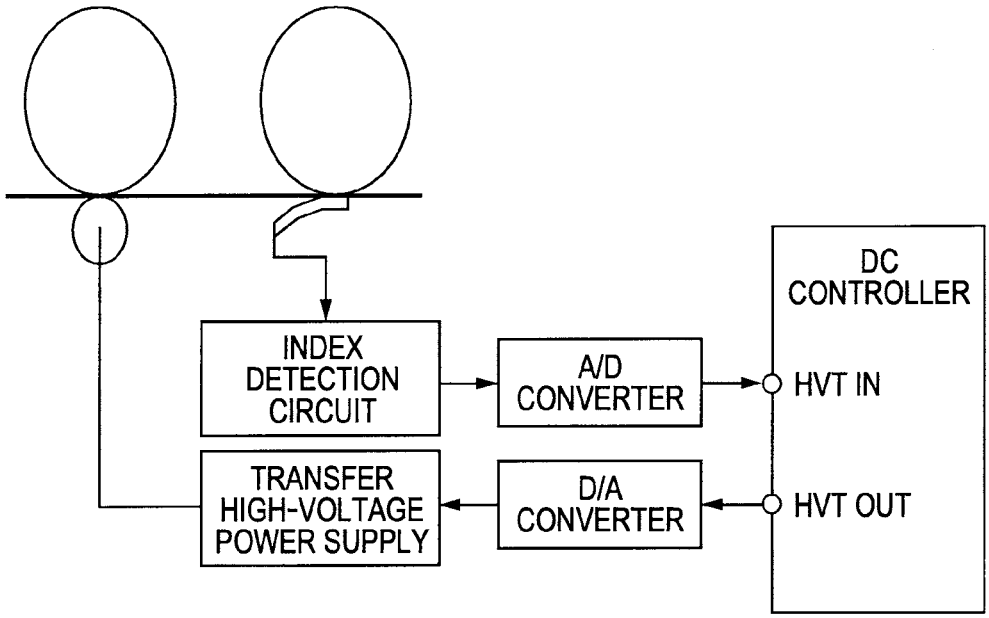
FIG. 23 is a block diagram in index ATVC control according to the second embodiment.
Figure 24:
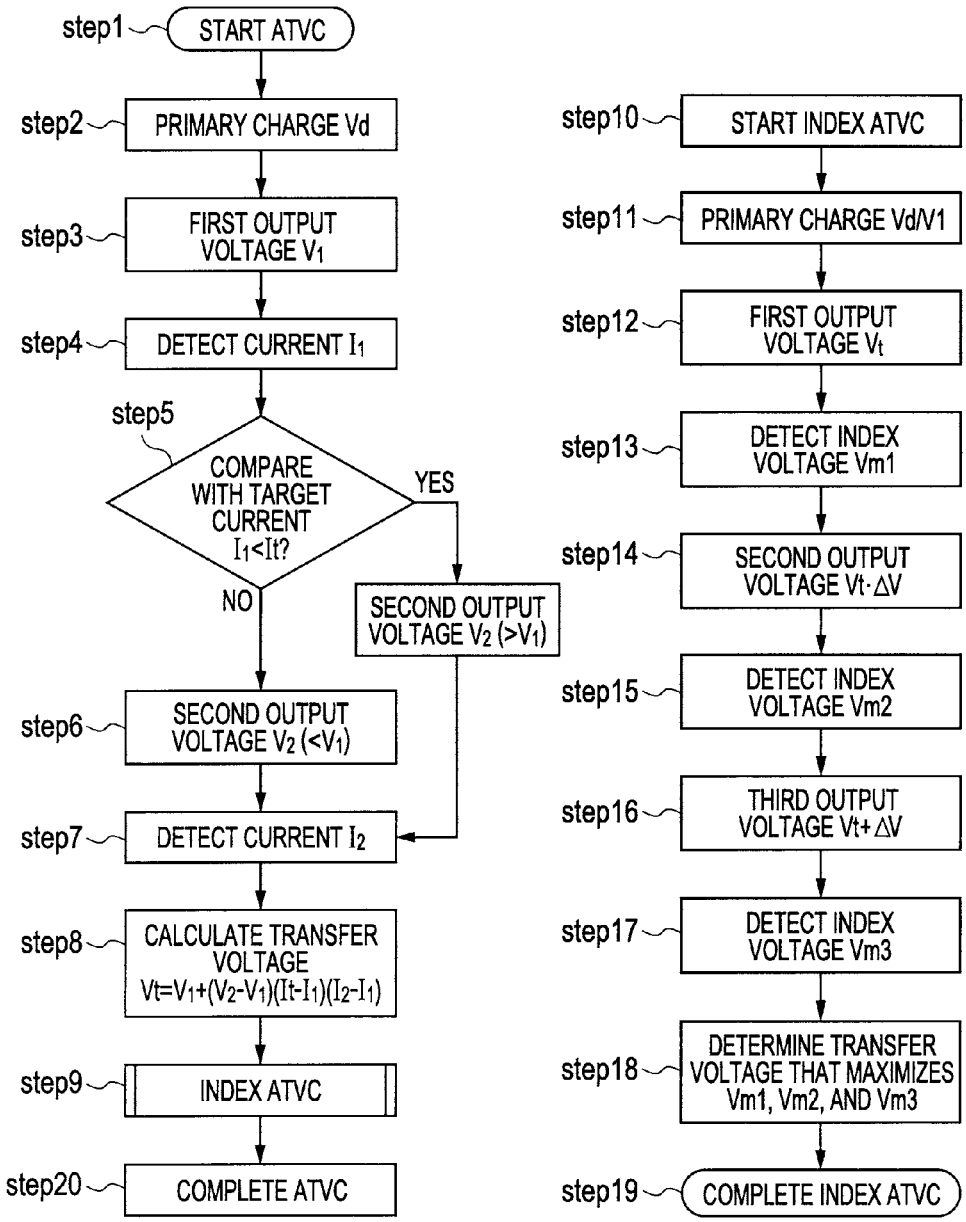
FIG. 24 is a flow chart illustrating the ATVC control and the index ATVC control according to the second embodiment.
Figure 25:
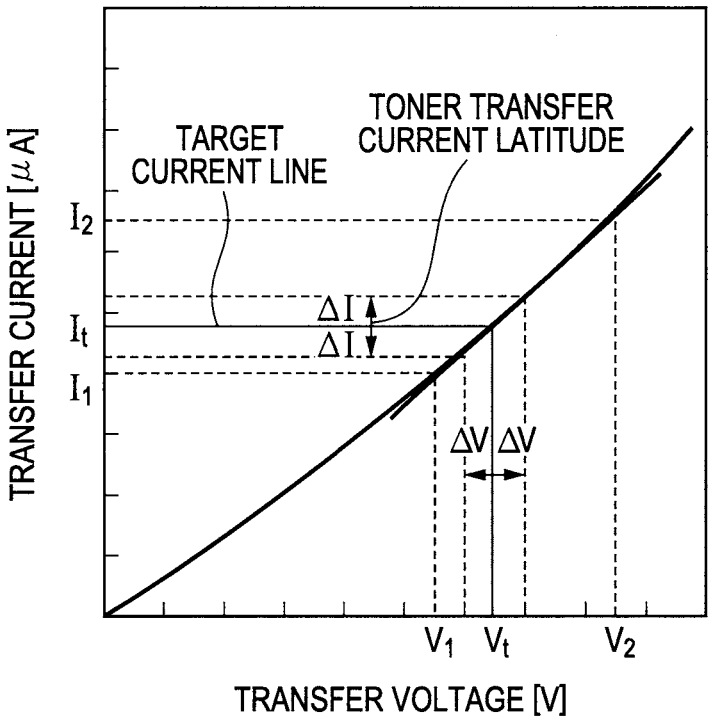
FIG. 25 is an explanatory view for obtaining a voltage Vt corresponding to a target current It according to the second embodiment.
Figure 26:
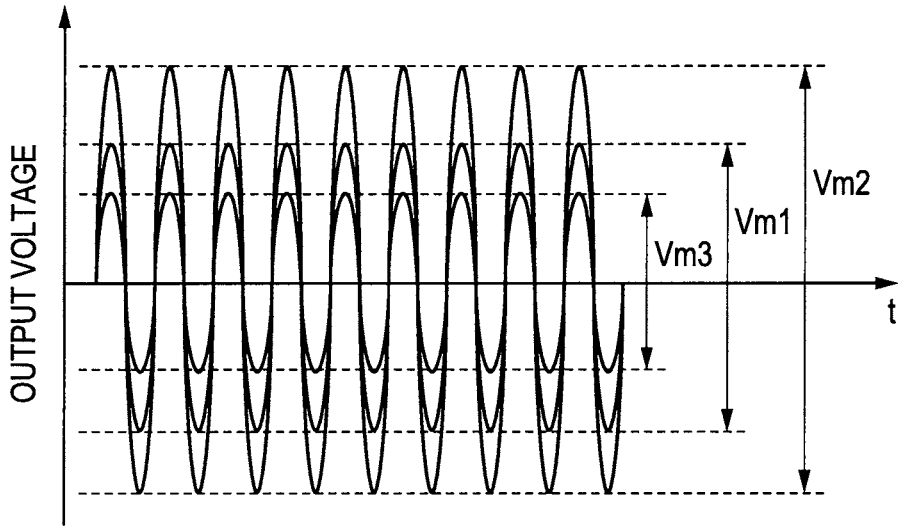
FIG. 26 is an explanatory view illustrating an example of an output voltage of an index read sensor according to the second embodiment.

ATVC control (Active Transfer Voltage Control) for performing the constant voltage control at the primary transfer section in the example will be illustrated. FIGS. 22 and 23 are block diagrams of the ATVC control and index ATVC control, respectively. FIG. 24 is a flow chart. FIG. 25 is an explanatory view for obtaining a voltage Vt corresponding to a target current It. FIG. 26 is an explanatory view illustrating an example of an output voltage of the index read sensor. The ATVC control is carried out at timing, such as when the power of the image forming apparatus is turned on and at the pre-rotation in the print operation or at interrupt control during consecutive printing.

In FIG. 24, at the timing of performing the ATVC control (step 1), the photosensitive drum and the intermediate transfer belt are rotated, and then a primary charge is turned on to charge the photosensitive drum with a constant potential Vd (step 2). Vd denotes a charge potential in the solid white image. A primary transfer voltage $V_1$ is applied (step 3), and a transfer current $I_1$ is detected (step 4). In the ATVC control, a DC controller of FIG. 22 applies the primary transfer voltage $V_1$ from HVT OUT of high-voltage output to the primary transfer roller through a D/A converter and a transfer high-voltage power supply. A transfer current output by the transfer high-voltage power supply is input to HVT IN through a detection circuit and an A/D converter.

The preset primary transfer target current It and the detected current $I_1$ are compared, and if $I_1$<It, a transfer voltage $V_2$ to be applied next is set greater than $V_1$, and if $I_1$>It, the transfer voltage $V_2$ to be applied next is set smaller than $V_1$ (step 5). The primary transfer voltage $V_2$ is applied (step 6), and a transfer current $I_2$ is detected (step 7). As illustrated in FIG. 25, a straight line indicating transfer voltage-current characteristics is drawn based on $V_1$, $V_2$, $I_1$, and $I_2$, and the voltage Vt corresponding to the target current It is obtained from the line (step 8).

In conventional ATVC, the ATVC is finished at this point. The present example moves to the index ATVC next (step 9). After the start of the index ATVC (step 10), the primary charge is turned on, and an image of four lines/four spaces is formed only in the index area at the exposed section (step 11).

The first output voltage Vt obtained before is applied to the primary transfer section (step 12), and the index read sensor detects an index output voltage Vm1 (step 13). In the index ATVC, a DC controller of FIG. 23 applies the primary transfer voltage Vt from HVT OUT of high-voltage output to the primary transfer roller through a D/A converter and a transfer high-voltage supply. The output voltage Vm1 output by the index read sensor is input to HVT IN through an index detection circuit and an A/D converter. A second output voltage Vt−ΔV is applied to the primary transfer section (step 14), and the index read sensor detects an index output voltage Vm2 (step 15).

A third output voltage Vt+ΔV is further applied to the primary transfer section (step 16), and the index read sensor detects an index output voltage Vm3 (step 17). A transfer voltage as a detection voltage with the largest output among Vm1, Vm2, and Vm3, i.e. largest Vpp, is selected (step 18), the transfer voltage is set as the primary transfer voltage in the next image formation, the index ATVC is finished (step 19), and the ATVC is finished (step 20). FIG. 26 illustrates an example of the output voltages Vm1, Vm2, and Vm3 of the index read sensor.

In the example, since Vm3<Vm1<Vm2, the second output voltage Vt−ΔV that outputs the largest Vm2 is the primary transfer voltage. The primary transfer voltage determined in the ATVC control is not changed until the next ATVC control is performed. The above Vd, $V_1$, $V_2$, ΔV, and timing of the ATVC control are determined based on various conditions, and in the present example, Vd=−500V, V1=1000, V2=500 or 1500V, and ΔV=200. As illustrated in FIG. 25, toner transfer latitude is ±ΔI relative to the target current, and ΔV is determined from an equivalent voltage.

The latitude depends on the shape factor of the toner, the application of an additive, the resistance value, etc., and the latitude can be appropriately set accordingly. To change the resistance values of the elastic conductive layers between the toner transfer section and the index transfer section, the amount of conducting agent in manufacturing of the transfer roller is generally changed. However, there is also a method of changing the diameters of the elastic conductive layers to change the sectional area nip widths, even with the same resistivity.

As illustrated, the apparatus can be constituted by extending the primary transfer roller to change the resistance values of the elastic conductive layers, and the toner image and the electrostatic latent image index can be transferred with the same voltage. Only one type of voltage setting value is necessary, and thus a more inexpensive electrophotographic apparatus can be provided by a simple device configuration.

Third Embodiment

Table 2 illustrates a third embodiment. Only parts different from the first and second embodiments will be illustrated. Compared to the second embodiment, the resistance value of the intermediate transfer belt is taken into account in the present embodiment. As illustrated in the first embodiment, the resistance value of the intermediate transfer belt is optimized for transfer functions in the toner transfer section and the index transfer section, and the configurations and the resistances are different.

TABLE 2

| | | Effective Image Area (Toner Transfer) | Electrostatic Latent Image Index Area (Index Transfer) |
|---|---|---|---|
| First Embodiment | Intermediate Transfer Belt Resistance Rb | 1E10 Ω | 1E14 Ω |
| | Transfer Roller Elastic Layer Electrical Resistance Value Rt | 1E6 Ω | 1E6 Ω |
| | Optimal Transfer Value Vt | 1000 V | 500 V |
| Second Embodiment | Intermediate Transfer Belt Resistance Rb | 1E10 Ω | 1E14 Ω |
| | Transfer Roller Elastic Layer Electrical Resistance Value Rt | 1E6 Ω | 2E7 Ω |
| | Optimal Transfer Value Vt | 1000 V | 1000 V |
| Third Embodiment | Intermediate Transfer Belt Resistance Rb | 1E10 Ω | 1E16 Ω |
| | Transfer Roller Elastic Layer Electrical Resistance Value Rt | 1E6 Ω | 3.84E7 Ω |
| | Optimal Transfer Value Vt | 1000 V | 1000 V |

Although the volume resistivity of the toner transfer section is made of a medium-resistance material of $10^9$ to $10^{10}$ Ω·cm to maintain the transfer performance, the transfer voltage for applying the optimal transfer current increases if the resistance is increased. As a result, the discharge easily occurs at the transfer section, and the toner easily spatters during the toner transfer due to the discharge. A defective image may be generated in which the toner images are disordered.

If the resistance of the intermediate transfer belt is increased, the charge provided at the transfer roller is held without being attenuated. Therefore, compared to the transfer voltage provided in the first image forming unit, a higher transfer voltage needs to be provided in the second image forming unit to apply the same current as the optimal transfer current provided in the first image forming unit. Similarly, the transfer voltage needs to be further increased for the third and fourth image forming units. Therefore, if the resistance value of the intermediate transfer belt in the toner transfer section is increased, the transfer voltage provided in the first, second, third, and fourth image forming units needs to be sequentially increased. In this case, a high output power supply needs to be used for the transfer high-voltage power supply, and this leads to an increase in the cost and an increase in the size of the apparatus.

After the first to fourth primary transfers have been finished, the intermediate transfer belt on which four color toner images are formed is moved to the secondary transfer section and is provided with the secondary transfer voltage for transfer to the recording material. The cleaning unit that cleans the secondary transfer residual toner cleans the intermediate transfer belt after the secondary transfer, and the electricity needs to be removed for the next primary transfer. Therefore, a neutralization mechanism is necessary. Alternatively, although a constant potential may be charged before the primary transfer, a charge mechanism for the charge is necessary.

To prevent complication of the apparatus, the toner transfer section of the intermediate transfer belt has a medium resistance of $10^9$ to $10^{10}$ Ω·cm, and the applied charge is attenuated. In this way, the capacity of the transfer high-voltage power supply is reduced, and the neutralization mechanism is not necessary.

Meanwhile, the index transfer section needs to hold the charge without attenuation, and thus the index transfer section is made of a high-resistance material with volume resistivity of $10^{14}$ Ω·cm or more. In this way, a function of holding the indexes is provided. In this case, as in the case of the toner transfer based on the high-resistance belt, the neutralization mechanism or the charge mechanism for uniform charge is necessary. Only the first image forming unit performs the index transfer, and unlike in the toner transfer, the sequential increase in the transfer voltage does not have to be taken into account.

A deviation in the optimal values of the toner transfer and the index transfer in relation to the resistance value of the intermediate transfer belt and a deviation in the optimal values of the toner transfer and the index transfer in relation to the transfer voltage illustrated in the second embodiment will be considered. The primary transfer roller 4*a* and the electrostatic belt index transfer roller 47 can be integrated by bringing the resistance value of the index transfer section of the transfer roller in line with the resistance value that can hold the indexes.

Fields of the resistance value of the intermediate transfer belt are added to the fields of the first and second embodiments of Table 2. In the present embodiment, Table 2 indicates that the optimal transfer voltages of the toner transfer and the index transfer match when the resistance value of the intermediate transfer belt of the index area is 1E16Ω and the resistance value of the transfer roller elastic layer is 3.84E7Ω.

Assuming that the resistance value of the intermediate transfer belt in the effective image area toner transfer is Rbi and that the resistance value of the intermediate transfer belt in the electrostatic latent image index area is Rbm, the following formula can be obtained.

$$Vti/b\cdot\mathrm{Log}_{10}\,Rbi+Rti=a\cdot Vtm/b\cdot\mathrm{Log}_{10}\,Rbm+Rtm \qquad \text{Expression 2}$$

Figure 27:
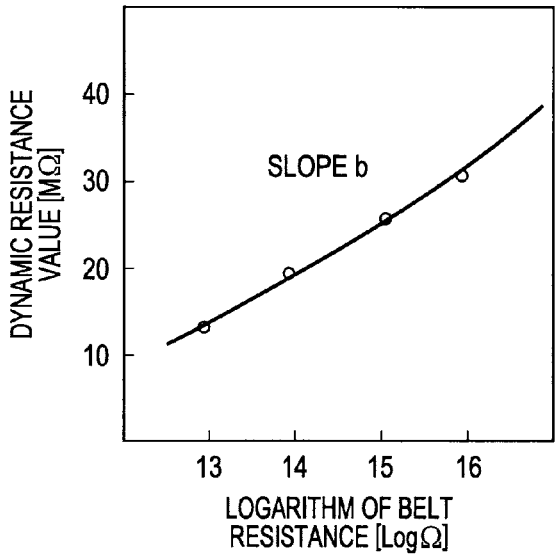
FIG. 27 illustrates a relationship between a belt resistance and a dynamic resistance value according to the second embodiment.

In the formula, a and b are proportional constants. As in the second embodiment, a denotes a correction factor based on the ratio of the sizes of the index area and the image area, the non-electrostatic adhesion force of the toner, etc. In the formula, b denotes a proportional constant between static electrical resistance value and dynamic electrical resistance value. FIG. 27 illustrates a relationship between the belt resistance and the dynamic resistance value verified by the present inventors. A slope of the straight line in FIG. 27 indicates the proportional constant b. This indicates that the logarithm of the belt resistance, i.e. volume resistivity, and the dynamic resistance are substantially proportional.

The static electrical resistance value is normal electrical resistance value. For example, assuming that the resistance value is R[Ω], the volume resistivity is ρ [Ωcm], the length of the resistor is 1 [cm], and the sectional area is s [$cm^2$], the following formula can be obtained.

$$R=\rho\cdot l/s$$

Meanwhile, assuming that the dynamic resistance value is Rd[Ω], the transfer current is It [A], and the transfer voltage is Vt [V], the dynamic resistance value is as follows.

$$Rd=Vt/It$$

The resistance value Rd is calculated from the voltage and the current output from the transfer high-voltage power supply and indicates an apparent resistance value of the transfer section. For example, when the intermediate transfer belt is an insulator, if the intermediate transfer belt is stopped, the transfer current does not flow even if the transfer voltage is applied, because the intermediate transfer belt is an insulator. The transfer current flows if the intermediate transfer belt is rotating. This phenomenon is analogized in a model in which when the insulated belt is regarded as a capacitor, the current does not flow when stopping, and a small empty capacitor is successively charged as a result of the rotation. The resistance value obtained from the transfer voltage and the transfer current is called a dynamic resistance value.

The dynamic resistance value includes the transfer current as a parameter. The transfer current is I=Q/t, where the movement amount current of charge per unit time is I [A], the amount of charge is Q [C], and the time is t [sec]. Therefore, the transfer current that provides the amount of charge corresponding to the amount of charge included in the toner depends on the process speed of the image forming apparatus. Therefore, the proportional constant b is a value dependent on the process speed.

The dynamic resistance value is taken into account for the intermediate transfer belt and is not applied to the transfer roller. If the elastic layer around the cored bar is an insulator, the current does not flow even if the transfer roller is rotated, and the transfer roller does not function from the beginning if there is no conductivity. Therefore, the resistance value of the transfer roller is the same during stoppage and rotation, and only the static resistance value needs to be taken into account. In this way, the combined resistance of the transfer section is a value dependent on the resistance of the intermediate transfer belt and the resistance of the transfer roller, and the combined resistance can be calculated by adding the dynamic resistance proportional constant b, which is proportional to the static resistance of the intermediate transfer belt, and the static resistance of the transfer roller.

Figure 28:
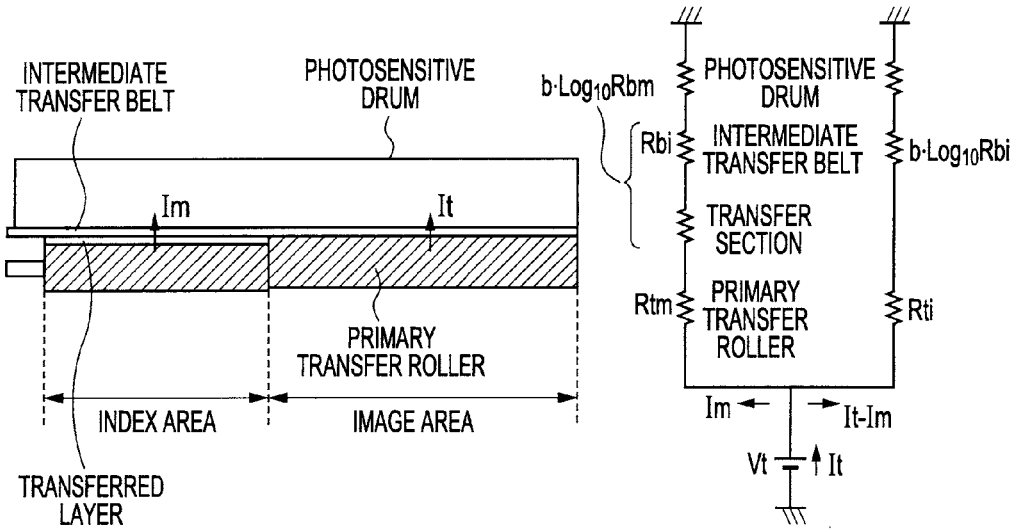
FIG. 28 illustrates a cross-section view near the index transfer area and an equivalent circuit.
Figure 29A:
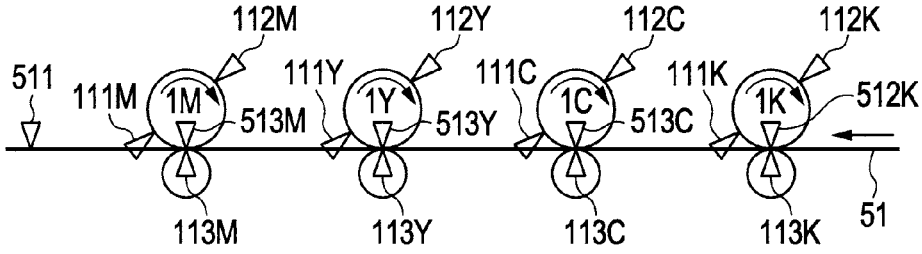
FIG. 29A (PRIOR ART)
FIG. 29A is a side view illustrating a conventional example.
Figure 29B:
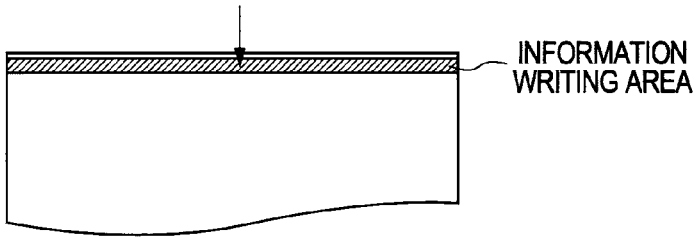
FIG. 29B (PRIOR ART)
FIG. 29B is a plan view illustrating the conventional example.

FIG. 28 illustrates a cross-sectional view and an equivalent circuit near the index transfer area. Im denotes a transfer current flowing through the index transfer area. In the image area, a current It−Im flows to a combined resistance calculated by a sum of the primary transfer roller resistance Rti, the dynamic resistance of the intermediate transfer belt b·Log Rbi, and the dynamic resistance of the photosensitive drum. In the index area, a current Im flows to a combined resistance calculated from a sum of the primary transfer roller resistance Rtm, the dynamic resistance of the intermediate transfer belt b·Log Rbm, and the dynamic resistance of the photosensitive drum. The left-hand side of Expression 2 denotes the combined resistance of the index area, and the right-hand side of Expression 2 denotes the combined resistance of the image area.

Therefore, Expression 2 can also be expressed as follows.

$$It-Im=a\cdot Im$$

For example, the following formula can be obtained in the case of the third embodiment of Table 2. The proportional constant a is 20, and the proportional constant b is 1E5.

$$1000V/1E5\times10\Omega+1E6\Omega=20\times1000V/1E5\times16\Omega+3.84E7\Omega$$

Although this is an example, the proportional constants can be set based on the transfer characteristics of the toner, the process speed, the sizes of the index area and the image area, as illustrated above. The control of the transfer voltage can be determined by performing the ATVC control as in the second embodiment.

In this way, the transfer voltages can be matched by setting the resistance value of the intermediate transfer belt and the resistance value of the elastic conductive layer of the transfer roller. More specifically, the apparatus can be constituted by extending the primary transfer roller to change the resistance value of the elastic conductive layer, and the toner image and the electrostatic latent image indexes can be transferred by the same voltage. Therefore, only one type of voltage setting value is required. As a result, a more inexpensive electrophotographic apparatus can be provided with a simple device configuration. The values presented in Table 2 are not limited to these, and the values change depending on other conditions. The values are optimized based on the concept illustrated above.

Although the high-resistance section of the index transfer section of the intermediate transfer belt and the belt index read sensor are arranged on the inner surface of the belt in the embodiments, an arrangement on the outer surface is also possible. The arrangement can be optimized by the design philosophy of the image forming apparatus.

Fourth Embodiment

The present embodiment relates to a configuration of detecting the electrostatic latent image of the photosensitive drum and the electrostatic latent image indexes on the intermediate transfer belt through the intermediate transfer belt. Parts different from the embodiments will be illustrated in the present embodiment.

Figure 30:
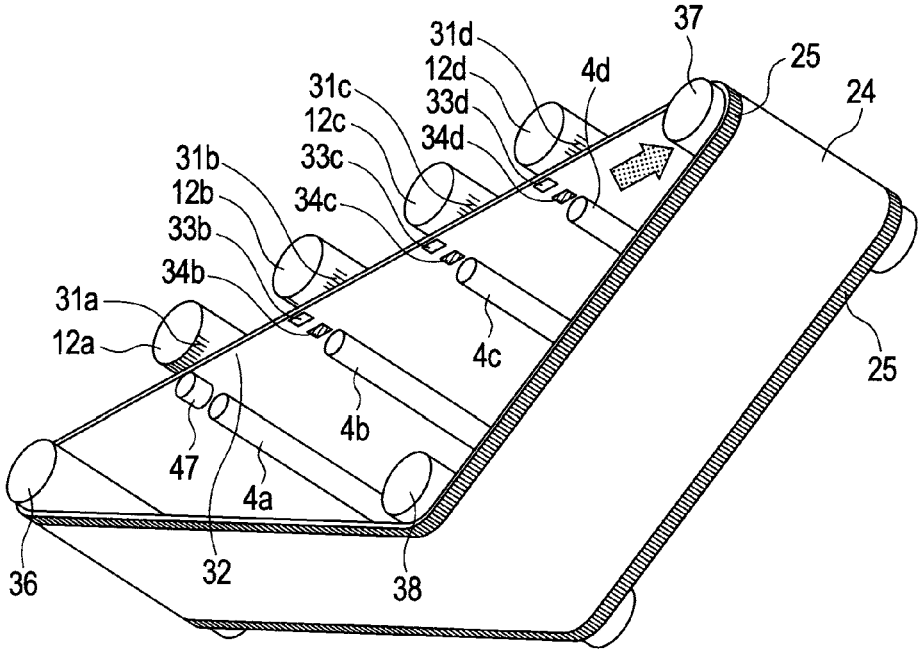
FIG. 30 is a schematic perspective view of a detection system that detects the electrostatic latent image indexes on the drums and the belt according to a fourth embodiment.

In the present embodiment, the belt index read sensor 33*b* and the electrostatic latent image index read sensor 34*b* come in contact with the surface opposite the side of the image bearing member of the intermediate transfer belt as illustrated in FIG. 30.

Figure 32:
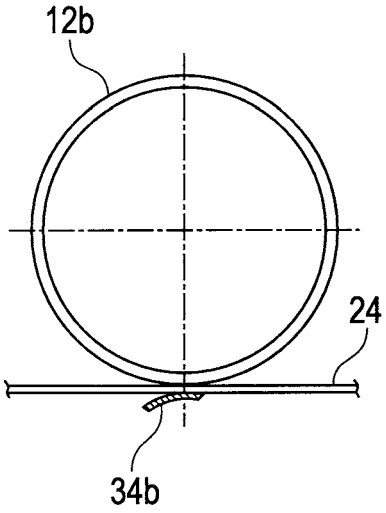
FIG. 32 illustrates an arrangement of the potential sensor that detects the electrostatic latent image indexes on the drum of the image forming unit on the downstream side of the fourth embodiment.

As illustrated in FIG. 32, the electrostatic latent image index read sensor 34*b* is arranged on the back surface of the intermediate transfer belt 24 at a position extending, in the photosensitive drum axial direction, a transfer position transfer line where the second photosensitive drum 12*b* and the intermediate transfer belt come into contact to transfer the toner image. The reason that the sensor is provided on the back surface of the intermediate transfer belt 24 is as follows.

If the electrostatic latent image index read sensor 34*b* is directly brought into contact with the photosensitive drum 12*b*, the index section and the detection electrode section of the sensor can be approximated, and the sensor output can be increased. Therefore, the detection accuracy can be improved by an increase in the SN ratio. However, although extremely few, there is toner floating circumference of the photosensitive drum 12*b* without being developed. The toner easily adheres to the electrostatic latent image index lines 31*b* that are the exposed sections of the photosensitive drum 12*b*.

Therefore, if the electrostatic latent image index read sensor 34*b* is directly brought into contact with the photosensitive drum 12*b*, the present inventors have confirmed that the toner adhered to the electrostatic latent image index lines 31*b* are accumulated on the contacting section in a long-time continuous operation. The inventors have confirmed that there is a clot of toner passing through the nip formed by the photosensitive drum 12*b* and the electrostatic latent image index read sensor 34*b* if more than a certain amount of toner is accumulated.

In that case, the gap between the photosensitive drum 12*b* and the electrostatic latent image index read sensor 34*b* changes, which causes a significant disorder of the output signal from the electrostatic latent image index read sensor 34*b*. Therefore, although the signal output somewhat drops, the photosensitive drum 12*b* and the electrostatic latent image index read sensor 34*b* are not in direct touch in the present embodiment, and the index is read through the intermediate transfer belt 24.

Figure 31:
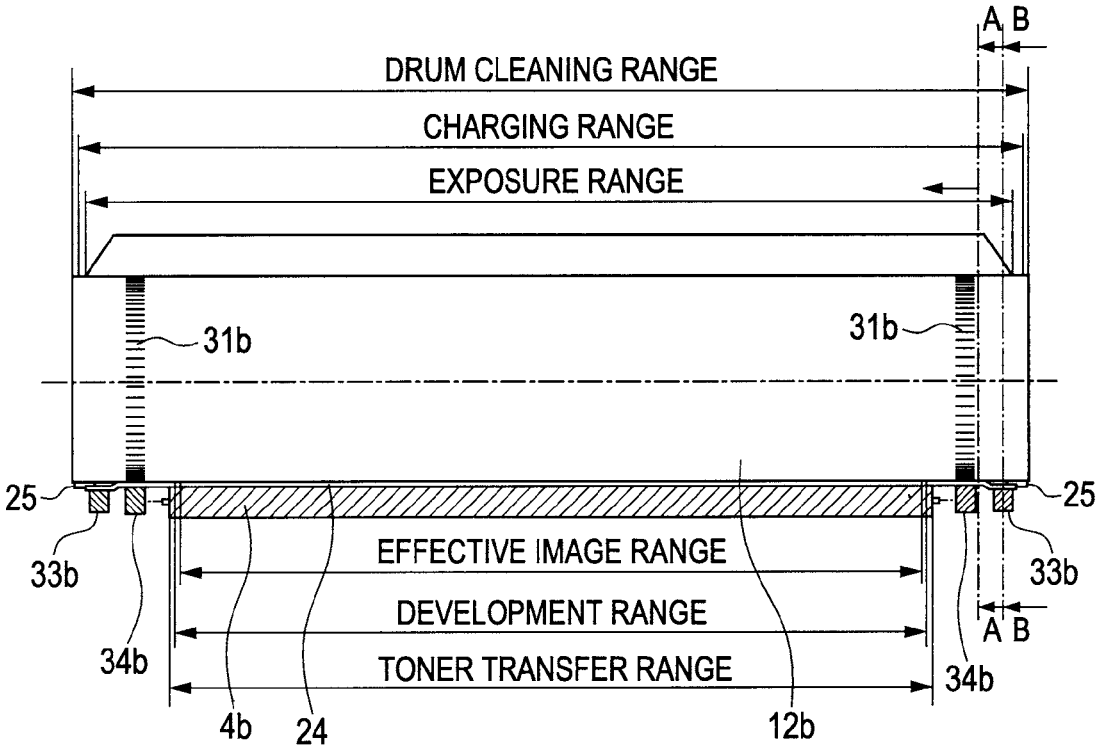
FIG. 31 is a side view illustrating an image forming unit on a downstream side of the fourth embodiment.
Figure 33:
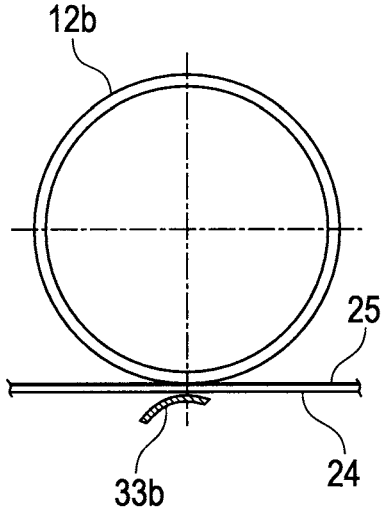
FIG. 33 describes an arrangement of the potential sensor that detects the electrostatic latent image indexes on the belt of the image forming unit on the downstream side of the fourth embodiment.

As illustrated in FIGS. 31 and 33, the belt index read sensor 33*b* is arranged on the back side of the intermediate transfer belt 24 in the second image forming unit 43*b* to allow detecting the electrostatic belt indexes 32 based on the electrostatic latent image transferred to the transferred section 25.

The space inside the intermediate transfer belt 24 is substantially closed by a back plate and a front plate for supporting the rollers around which the intermediate transfer belt 24 is wound, and it is relatively difficult for the floating toner to enter based on the structure. Therefore, the toner does not accumulate on the nip formed by the intermediate transfer belt 24 and the electrostatic latent image index read sensor 34 even in a long-time continuous operation. Therefore, a stable output can be obtained, and a more reliable apparatus can be provided.

As illustrated, the belt index read sensor 33*b* and the electrostatic latent image read sensor 34*b* are arranged on the back surface of the intermediate transfer belt 24 in the second image forming unit 43*b*. The sensors are arranged to be able to read the electrostatic latent image index lines 31*b* on the photosensitive drum 12*b* and the electrostatic belt indexes 32 transferred to the transferred section 25 of the intermediate transfer belt 24, on the same line as the transfer line. Therefore, in the present embodiment, the position of the electrostatic latent image index read sensor 34 as a first detection unit and the position of the belt index read sensor 33 as a second detection unit match in the movement direction of the intermediate transfer belt.

(Configurations of Two Detection Units)

Specific configurations of the sensors as two detection units will be illustrated with reference to FIGS. 34 and 35. The electrostatic latent image index read sensor 34 and the belt index read sensor 33 are potential change detection sensors that can detect changes in the potential, and the basic configurations are described in detail in Japanese Patent Application Laid-Open No. H11-183542. Therefore, only parts specific to the present embodiment will be illustrated.

Figure 34:
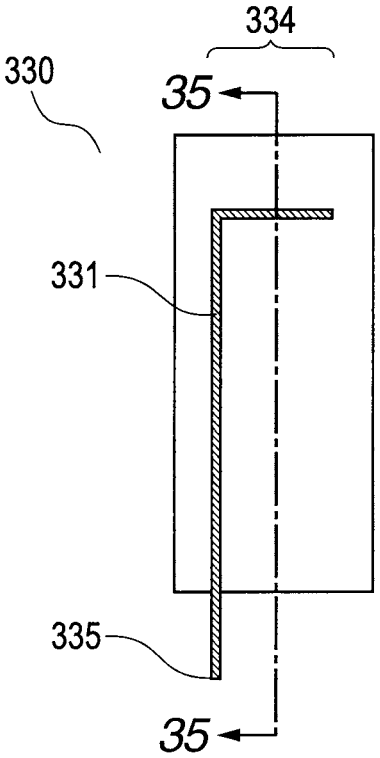
FIG. 34 is a plan view illustrating a configuration of the potential sensor according to the fourth embodiment.

FIG. 34 illustrates a configuration of the potential sensor 330 used in the present embodiment. FIG. 35 illustrates a cross section 35-35 of FIG. 34. As illustrated in FIG. 34, the lead wire 331 made of a metal wire with a diameter of 10 μm is bent in an L shape. The tip of the lead wire 331 serves as the detection section 334, and the length of the detection section 334 is about 2 mm.

Figure 35:
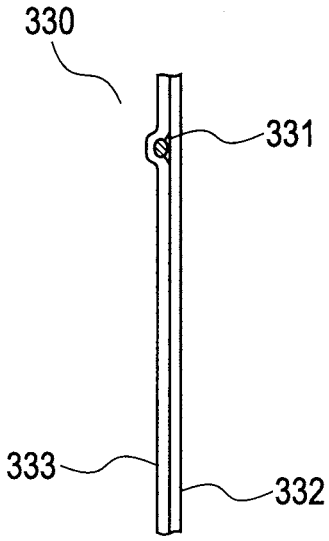
FIG. 35 is a side view illustrating the configuration of the potential sensor according to the fourth embodiment.

As for the configuration of the potential sensor 330, the lead wire 331 bent in the L shape is arranged after applying an adhesive on the base film 332 made of a polyimide film with width 4 mm, length 15 mm, and thickness 25 μm, as illustrated in FIGS. 34 and 35. The protection film 333 made of a polyimide film with equivalent size and thickness as the base film 332 is adhered over the lead wire 331. Although not illustrated in FIG. 35, the adhesive mainly exists between the base film 332 and the protection film 333 and does not exist between the lead wire 331 and the base film 332 and between the lead wire 331 and the protection film 333.

Therefore, the distance between the surface of the lead wire 331 and the surface of the base film 332 or the protection film 333 is 25 μm. The opposite end of the detection section 334 of the L-shaped lead wire 331 is the output section 335 of signal.

In this way, even in the configuration of detecting the electrostatic latent image of the photosensitive drum and the electrostatic latent image indexes on the intermediate transfer belt through the intermediate transfer belt, the position of the electrostatic latent image of the photosensitive drum and the position of the electrostatic latent image indexes on the intermediate transfer belt can be matched.

Fifth Embodiment

Figure 36:
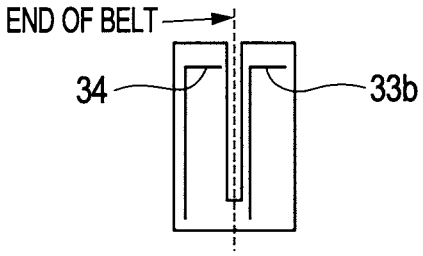
FIG. 36 is a plan view illustrating a configuration of two potential sensors on the same substrate according to a fifth embodiment.
Figure 37:
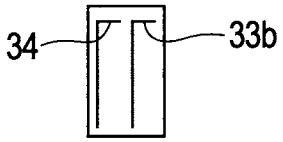
FIG. 37 is a plan view illustrating a configuration in which the two potential sensors on the same substrate are brought closer according to the fifth embodiment.

FIGS. 36, 37, 38, and 39 illustrate a fifth embodiment according to the present invention. Only parts different from the above embodiments will be illustrated. As illustrated in FIGS. 36 and 37, the belt index read sensor 33 and the electrostatic latent image index read sensor 34 are formed on the same flexible printed substrate in the present embodiment, and the detection sections are arranged in a straight line as illustrated. There is a cut between two detection sections in FIG. 36.

In FIG. 36, the transferred section 25 is on the front surface side of the intermediate transfer belt 24. As a result, even if there is unevenness on the back surface of the intermediate transfer belt 24, the detection sections can come in contact without one-side hitting the back surface of the belt. In the case of FIG. 24, the two detection sections can be brought closer, compared to the case of FIG. 23, and arranged on the rectangular flexible printed substrate.

In the case of FIG. 24, if the thickness of the transferred section 25 is about 30 μm as illustrated in the first embodiment, the unevenness would be extremely small even if there is unevenness. Therefore, if the flexible printed substrate is used, the contact is possible without one-side hitting, even if there is no cut as illustrated in FIG. 36. The configuration without the cut can reduce the size of the entire sensor flexible printed substrate, and the sensor flexible printed substrate can be manufactured at low cost.

Figure 38:
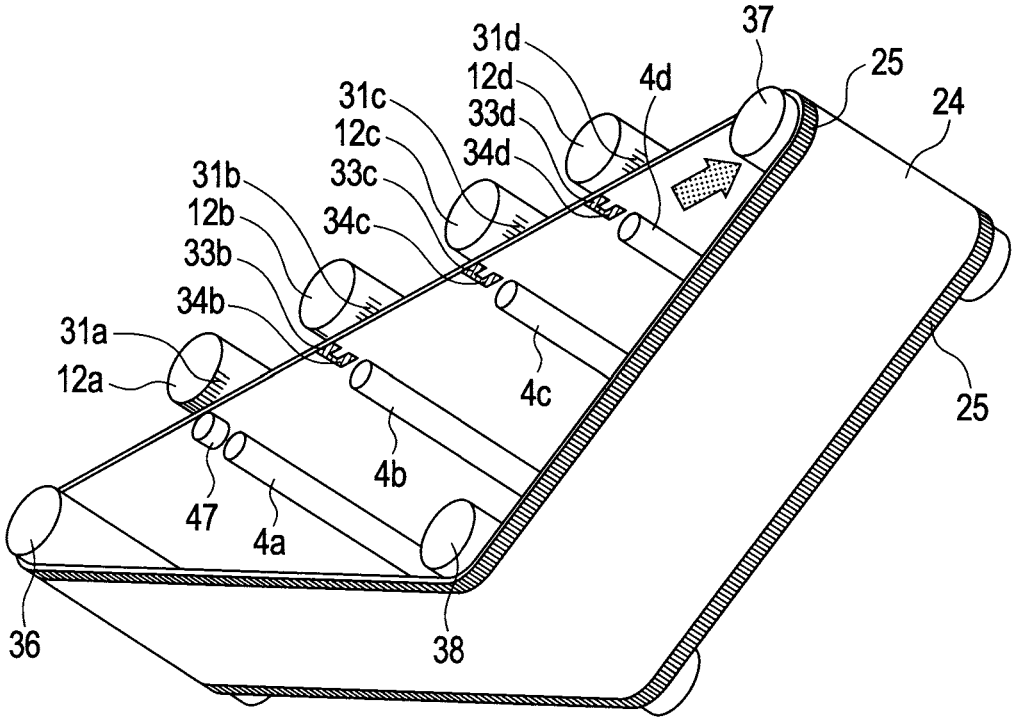
FIG. 38 is a perspective view illustrating the fifth embodiment.
Figure 39:
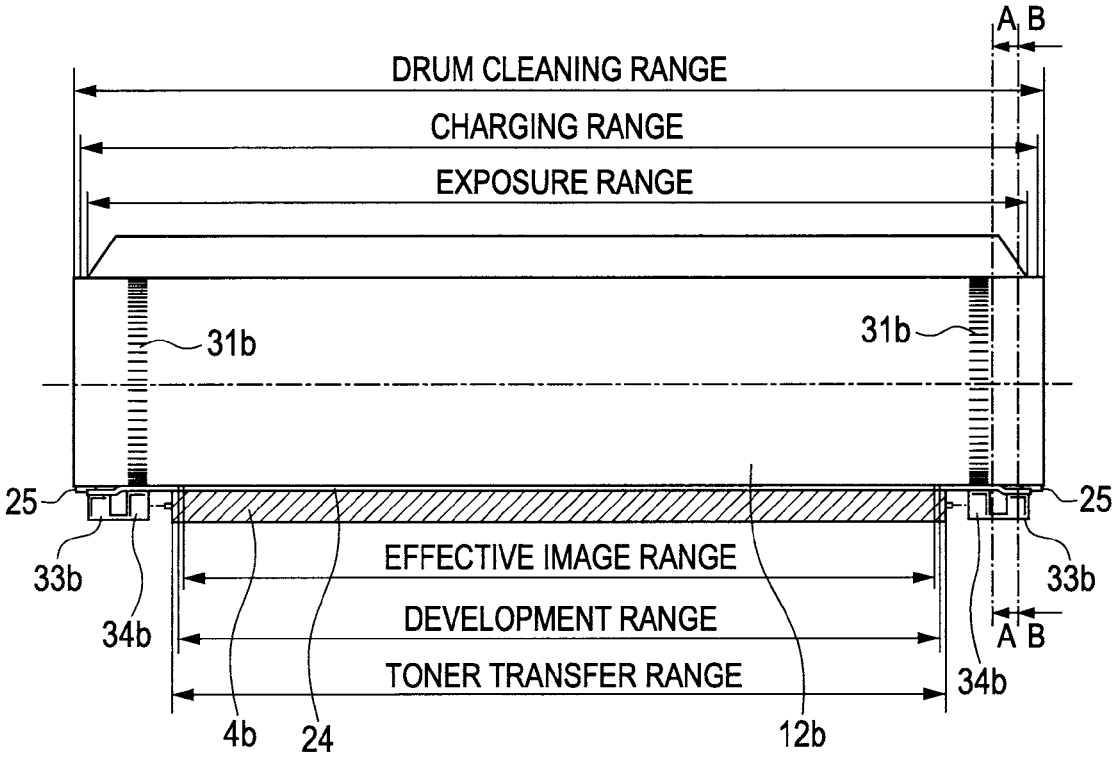
FIG. 39 is a side view illustrating the image forming unit on the downstream side of the fifth embodiment.

FIGS. 38 and 39 illustrate states in which the sensors as illustrated in FIG. 36 are incorporated into the belt unit. In FIG. 38, the sensors illustrated in FIG. 36 are arranged on the back side of the intermediate transfer belt 24 in the second image forming unit 43*b*, the third image forming unit 43*c* and the fourth image forming unit 43*d*. The detection sections can come in contact with the electrostatic belt index 32 transferred to the transferred section 25 of the intermediate transfer belt 24 and the electrostatic latent image indexes 31*b* formed at the end of the photosensitive drum 12*b* through the intermediate transfer belt 24 to detect the indexes. Other than this, the configuration is the same as in the first embodiment. FIG. 39 illustrates a side view of the second image forming unit 43*b*, the third image forming unit 43*c* and the fourth image forming unit 43*d*. Reading of the indexes on the belt and the indexes on the drum by the integrated sensors as in the present embodiment can reduce the number of components and reduce the space for arranging the sensors. Therefore, the size of the apparatus can be reduced. The formation of the antenna sections on the same flexible printed substrate can locate the drum latent image read position and the belt latent image read position at the same position in the sub scanning direction, and positioning control with few errors is possible. Even if the sensor positions are changed by vibrations, the antenna sections are formed on the same flexible printed substrate. Therefore, the relative position in the transport direction rarely deviates, compared to when the antenna sections are separately provided. Therefore, more highly accurate positioning can be realized. Based on the output amplitude from the electrostatic latent image index read sensors 34*b* to 34*d* for the drums, determining the position to maximize the value can position the electrostatic latent image index read sensors 34*b* to 34*d* at the toner transfer position. The positions of the integrated belt index read sensors 33*b* to 33*d* can also be determined at the same time.

Although the embodiments of the present invention have been illustrated, the present invention is not limited by the embodiments in any sense, and any modifications are possible within the technical concept of the present invention.

While the present invention has been illustrated with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-093219, filed Apr. 19, 2011, and No. 2011-093218 filed Apr. 19, 2011 which are hereby incorporated by reference herein in their entirety.

What is claimed is:

1. An image forming apparatus comprising:

a movable intermediate transfer member;

a first image forming unit including a rotatable first image bearing member that forms a toner image to be transferred to the intermediate transfer member, a second image forming unit arranged on a downstream side of the first image forming unit in a moving direction of the intermediate transfer member and including a rotatable second image bearing member that forms a toner image to be transferred to the intermediate transfer member;

first index forming means that forms a plurality of first electrostatic latent image indexes at positions adjacent to a toner image to be formed on a recording material in a width direction of the first image bearing member, the first electrostatic latent image indexes formed along the toner image to be formed on the recording material from a position on an upstream side of a leading end of the toner image to be formed on the recording material in a rotation direction of the first image bearing member, wherein a section of the first electrostatic latent image indexes formed on a downstream side of the leading end of the toner image is formed so as to have larger index intervals than a section adjacent to the toner image;

a transfer unit that transfers the first electrostatic latent image indexes formed on the first image bearing member to the intermediate transfer member;

second index forming means that forms a plurality of second electrostatic latent image indexes at positions adjacent to a toner image to be formed on the recording material in a width direction of the second image bearing member, the second electrostatic latent image indexes formed along the toner image to be formed on the recording material from a position on a downstream side of a leading end of the toner image to be formed on the recording material in a rotation direction of the second image bearing member, wherein a section of the second electrostatic latent image indexes formed on the downstream side of the leading end of the toner image is formed so as to have larger index intervals than a section adjacent to the toner image;

a first detection unit that comes in contact with a surface of the intermediate transfer member opposite a surface of the intermediate transfer member facing the second image bearing member, and that detects the second electrostatic latent image indexes;

a second detection unit that comes in contact with the surface of the intermediate transfer member opposite the surface of the intermediate transfer member facing the second image bearing member, and that detects the first electrostatic latent image indexes transferred to the intermediate transfer member; and a control unit that controls an operation of at least the second image forming unit so as to maintain a set positional relationship between the first electrostatic latent image indexes transferred to the intermediate transfer member and the second electrostatic latent image indexes based on detection results by the first detection unit and the second detection unit.

2. The image forming apparatus according to claim 1, wherein a resistance value of an area of the intermediate transfer member where the first electrostatic latent image indexes are transferred is greater than a resistance value of an area of the intermediate transfer member where the toner image is formed.

3. The image forming apparatus according to claim 1, wherein the first detection unit and the second detection unit are formed on a same substrate.

4. An image forming apparatus comprising:

a movable intermediate transfer member;

a first image forming unit including a rotatable first image bearing member that forms a toner image to be transferred to the intermediate transfer member on the first image bearing member;

a second image forming unit arranged on a downstream side of the first image forming unit in a moving direction of the intermediate transfer member and including a rotatable second image bearing member that forms a toner image to be transferred to the intermediate transfer member on the second image bearing member;

first index forming means that forms a plurality of first electrostatic latent image indexes at positions adjacent to a toner image to be formed on a recording material in a width direction of the first image bearing member;

a transfer unit that transfers the first electrostatic latent image indexes formed on the first image bearing member to the intermediate transfer member;

second index forming means that forms a plurality of second electrostatic latent image indexes at positions adjacent to a toner image to be formed on the recording material in a width direction of the second image bearing member;

a first detection unit that comes in contact with a surface of the intermediate transfer member opposite a surface of the intermediate transfer member facing the second image bearing member, and that detects the second electrostatic latent image indexes;

a second detection unit that comes in contact with the surface of the intermediate transfer member opposite the surface of the intermediate transfer member facing the second image bearing member, and that detects the first electrostatic latent image indexes transferred to the intermediate transfer member; and a control unit that controls an operation of at least the second image forming unit so as to maintain a set positional relationship between the first electrostatic latent image indexes transferred to the intermediate transfer member and the second electrostatic latent image indexes based on detection results by the first detection unit and the second detection unit.

5. The image forming apparatus according to claim 4, wherein the first detection unit and the second detection unit are formed on a same substrate.

6. The image forming apparatus according to claim 4, wherein the first detection unit is arranged more inside than the second detection unit in a width direction of the second image bearing member.

* * * * *